US005711466A

United States Patent [19]

Kataoka et al.

[11] Patent Number: 5,711,466

[45] Date of Patent: Jan. 27, 1998

[54] BABY HOLDER

[75] Inventors: Sachiyo Kataoka; Yukio Kakimoto, both of Osaka,, Japan

[73] Assignee: Aprica Kassai Kabushikikaisha, Osaka, Japan

[21] Appl. No.: 703,737

[22] Filed: Aug. 27, 1996

[30] Foreign Application Priority Data

Sep. 11, 1995 [JP] Japan ..... 7-232151
Sep. 11, 1995 [JP] Japan ..... 7-232152

[51] Int. Cl.[6] ..... A47D 13/02

[52] U.S. Cl. ..... 224/159

[58] Field of Search ..... 224/161, 159

[56] References Cited

U.S. PATENT DOCUMENTS

| | | | |
|---|---|---|---|
| 4,458,834 | 7/1984 | Rosen | 224/159 X |
| 4,915,277 | 4/1990 | Larreategui | 224/159 |
| 5,205,450 | 4/1993 | Derosier | 224/161 |
| 5,492,256 | 2/1996 | Ive | 224/159 |
| 5,509,590 | 4/1996 | Mrdeiros, Jr. et al. | 224/161 |

FOREIGN PATENT DOCUMENTS

| | | | |
|---|---|---|---|
| 0480573 | 4/1992 | European Pat. Off. . | |
| 1215795 | 4/1960 | France | 224/159 |
| 4-46619 | 11/1992 | Japan . | |
| 2260687 | 4/1993 | United Kingdom . | |

*Primary Examiner*—Renee S. Luebke
*Attorney, Agent, or Firm*—W. G. Fasse; W. F. Fasse

[57] ABSTRACT

A baby holder (1) to be worn in the form of a waist pouch includes a waist strap (3) which is worn around the waist of a wearer and a support (6) which is mounted on the waist strap (3) and positioned to extend from the wearer's abdomen so that a seat surface (5) for receiving the buttocks of a baby is formed on the support (6). In order to stably hold the baby while keeping it in a good posture, a pad wall (7) is provided on the support (6) to extend upright from the seat surface (5) so that this pad wall (7) supportingly contacts the back of the baby who is held in a backward orientation, or is located between the legs of the baby who is held in a forward facing orientation. The pad wall (7) has a T-shaped front surface, and is rotatably mounted on the support (6) to be selectively tiltable into an upright position for supporting the baby and a folded-down position extending along the seat surface (5).

21 Claims, 24 Drawing Sheets

BABY HOLDER

BACKGROUND OF THE INVENTION

1. Field of the Invention

The present invention relates to a baby holder which is worn in the form of a waist pouch comprising a support forming a seat surface for receiving the buttocks of a baby, and more particularly, it relates to an improvement for stabilizing the baby's posture on the baby holder.

2. Description of the Background Art

For example, Japanese Utility Model Publication No. 4-46619 (1992) discloses a baby holder which is of interest to the present invention. This baby holder comprises a support forming a seat surface for receiving the buttocks of a baby, and this support is mounted on a waist strap which is worn around the waist of the wearer. Further, this baby holder comprises a wrist strap extending from the front part of the seat surface so that the wearer wears this strap on his or her wrist for holding the baby. Thus, the wearer can stably carry the baby on the baby holder while preventing the baby from falling therefrom.

In order to implement the state of stably holding the baby and preventing it from falling with the aforementioned wrist strap, however, the wearer must carry the baby while wearing the strap on his Or her wrist. The wrist strap is not self-sustaining or self-supporting and cannot support the baby without the help of the wearer.

Consequently, one hand of the wearer is constantly restrained by the wrist strap, and the wearer cannot freely use both hands while holding the baby.

Further, the wrist strap relatively readily deforms in an arbitrary direction. Depending on the position of the wearer's hand, therefore, the baby may disadvantageously be forced into an unnatural posture.

SUMMARY OF THE INVENTION

Accordingly, an object of the present invention is to provide a baby holder which can solve the aforementioned problems.

The present invention is directed to a baby holder comprising a waist strap which is worn around the waist of the wearer, and a support, forming a seat surface for receiving the buttocks of a baby, which is mounted on the waist strap and positioned to extend from the wearer's abdomen. In order to solve the aforementioned technical problems, a pad wall is provided on the support and is adapted to be moved to extend upright from the support.

According to the present invention, the pad wall is provided to be tiltable upright from the seat surface, whereby the buttocks of the baby can be prevented from slipping off the seat surface. Thus, the baby can be prevented from falling off the support.

Further, the pad wall can be charged or fitted internally with a core having sufficient rigidity or the like to be self-sustaining, thereby exhibiting the aforementioned function without help of the wearer. Thus, the wearer can freely use both hands, for example, to quickly cope with a dangerous situation or the like, thereby improving the safety.

Due to the presence of the pad wall, further, the baby's backbone can be protected against abnormal curvature, whereby the baby can be regularly kept in a good posture. Thus, it is possible to provide a baby holder which can contribute to the baby's health.

According to the present invention, the pad wall is preferably rotatably mounted on the support to be capable of selectively assuming a state extending along the seat surface and a state being tilted upright from the seat surface respectively. Due to this structure, the bulk of the baby holder can be reduced by bringing the pad wall into the state extending along the seat surface when the baby is not received on the support, whereby the portability of the baby holder can be further improved. In case of using the pad wall, on the other hand, it is possible to immediately bring the pad wall into a usable state by simply rotating the same into an upright position.

The pad wall may be rendered removable from the support, for enabling the aforementioned reduction of the bulk of the baby holder when the pad wall is not used.

When the pad wall is rotatably mounted on the support, the baby holder may further comprise an elastic member for urging the pad wall and rotating the same into the state extending upright from the seat surface and an engaging member for maintaining the pad wall in the state extending along the seat surface against the elasticity of the elastic member. Due to this structure, the pad wall can be automatically uprighted, i.e. tilted upright, when the engaging member is disengaged, whereby the operability of the baby holder can be improved.

The pad wall may be rendered height-controllable. Due to such height controllability of the pad wall, the height of the pad wall can be varied as the baby grows, while it is possible to prevent unnecessary bulkiness of the baby holder resulting from presence of a pad wall which is excessively high for the build of the baby.

Further, the horizontal position of the pad wall may be rendered adjustable. In this case, the position of the pad wall can be adjusted as the baby grows.

The pad wall preferably has a T-shaped front surface. In this case, it is possible to implement both a state of holding the baby forward toward the pad wall so that the baby has its back to the wearer, and a state of holding the baby backward against the pad wall so that it faces the wearer, with no problem. In other words, such a T-shaped pad wall has an upper portion that provides a relatively wide surface for supporting the baby, while allowing a natural arrangement of the baby's legs around a narrower lower portion when the baby is seated toward the pad wall.

Further, both end portions of the pad wall are preferably curved to approach the wearer on the upper surface. In this case, the pad wall can further fit the baby's body, for further stably supporting the baby.

In the seat surface and the pad wall, at least regions coming into contact with the baby's body are preferably charged or fitted internally with a first cushion member, a second cushion member having a larger elastic coefficient than the first cushion member and being arranged at the back of the first cushion member, and a third cushion member having a larger elastic coefficient than the second cushion member and being arranged at the back of the second cushion member. Due to such a cushion structure including three layers of cushion members, substantially only the first cushion member can deform to provide a preferable soft touch for the baby under usual or ordinary conditions while the second and third cushion members successively serve as shock absorbers against a strong shock, whereby a high reliability for shock absorptivity can be expected and the safety of the baby holder can be further improved.

According to the present invention, when the support comprises a holding core having an upper surface extending along the seat surface and a rear surface extending along the wearer's abdomen for keeping the support in shape, the waist strap preferably has a front strap part passing around the front surface of the holding core, so that this front strap part is fixed to the holding core. In this case, the front strap part raises the front portion of the holding core and supports it against going down, whereby the seat surface can be maintained in a substantially horizontal state without strongly bringing the rear surface of the holding core into contact with the wearer's abdomen. Thus, the wearer can be effectively prevented from being pressed or being inhibited from free movement.

According to the present invention, the waist strap more preferably comprises a rear strap part passing along the rear surface of the holding core in addition to the front strap part, so that the front and rear strap parts are coupled with each other on both sides of the holding core. Due to this structure, stability of the holding core is increased while the position of the front strap part can be further stabilized, whereby the front strap part can effectively exhibit the aforementioned function.

Further preferably, the height of the front strap part on the front surface of the holding core is selected to be lower than that of the rear strap part on the rear surface of the holding core in the present invention. Due to this structure, the front strap part can even more effectively serve the purpose of raising the front portion of the holding core.

The pad wall may be rendered adjustable in width. Thus, the width of the pad wall can be adjusted as the baby grows, while it is possible to prevent unnecessary bulkiness of the baby holder resulting from presence of a pad wall which is excessively wide for the build of the baby.

The baby holder according to the present invention may further comprise a curved surface forming member for forming a curved surface along the baby's buttocks on an internal angle portion which is defined between the pad wall and the seat surface. Due to such a curved surface forming member, it is possible to further stabilize the baby's buttocks while providing a preferable touch for the baby.

BRIEF DESCRIPTION OF THE DRAWINGS

FIG. 2 1 is a side elevational view showing a holding core 10 and a waist strap **3*a*** provided on a baby holder according to a further embodiment of the present invention;

DESCRIPTION OF THE PREFERRED EMBODIMENTS

Figure 1:
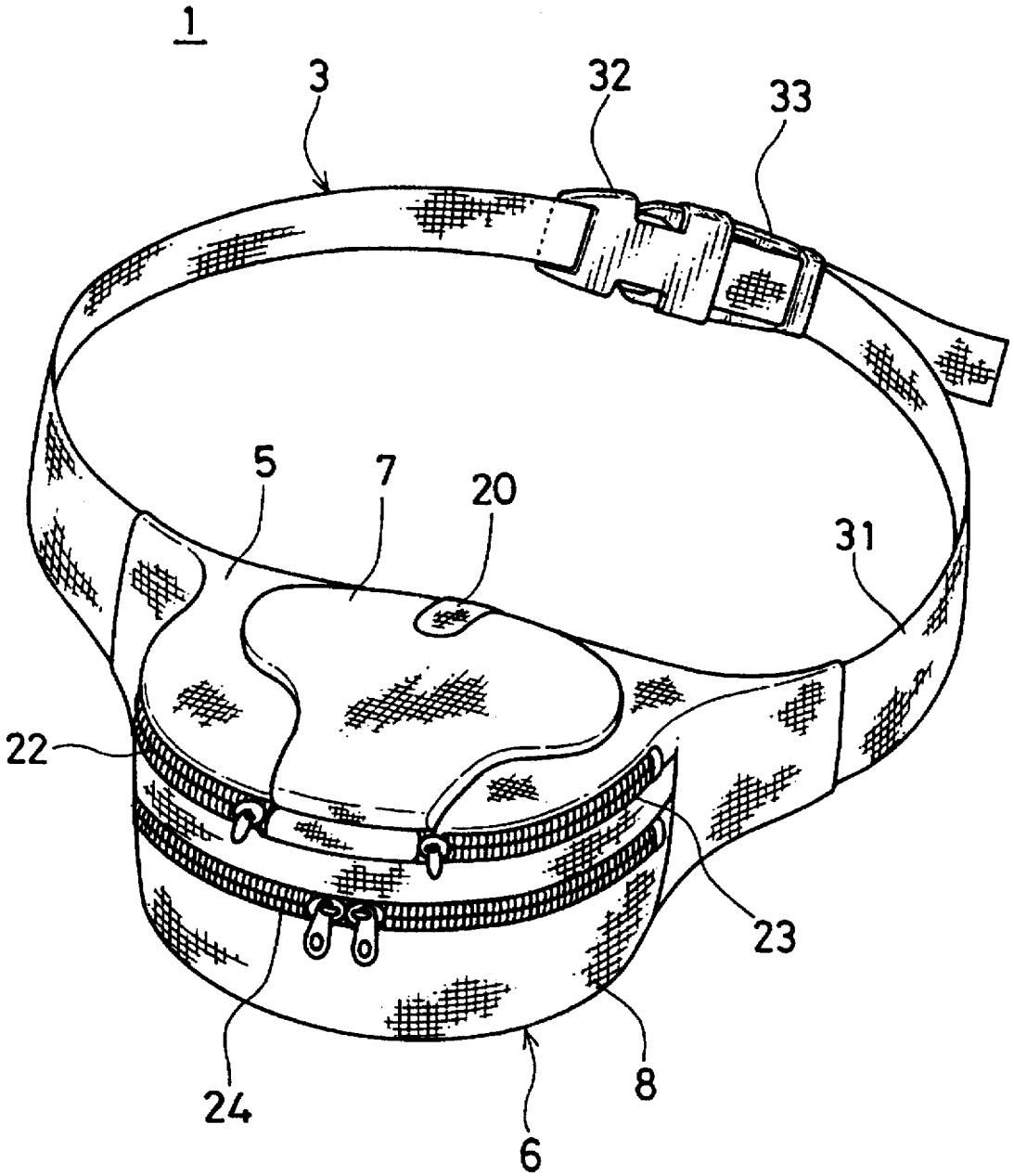
FIG. 1 is a perspective view showing the overall appearance of a baby holder 1 according to an embodiment of the present invention.
Figure 2:
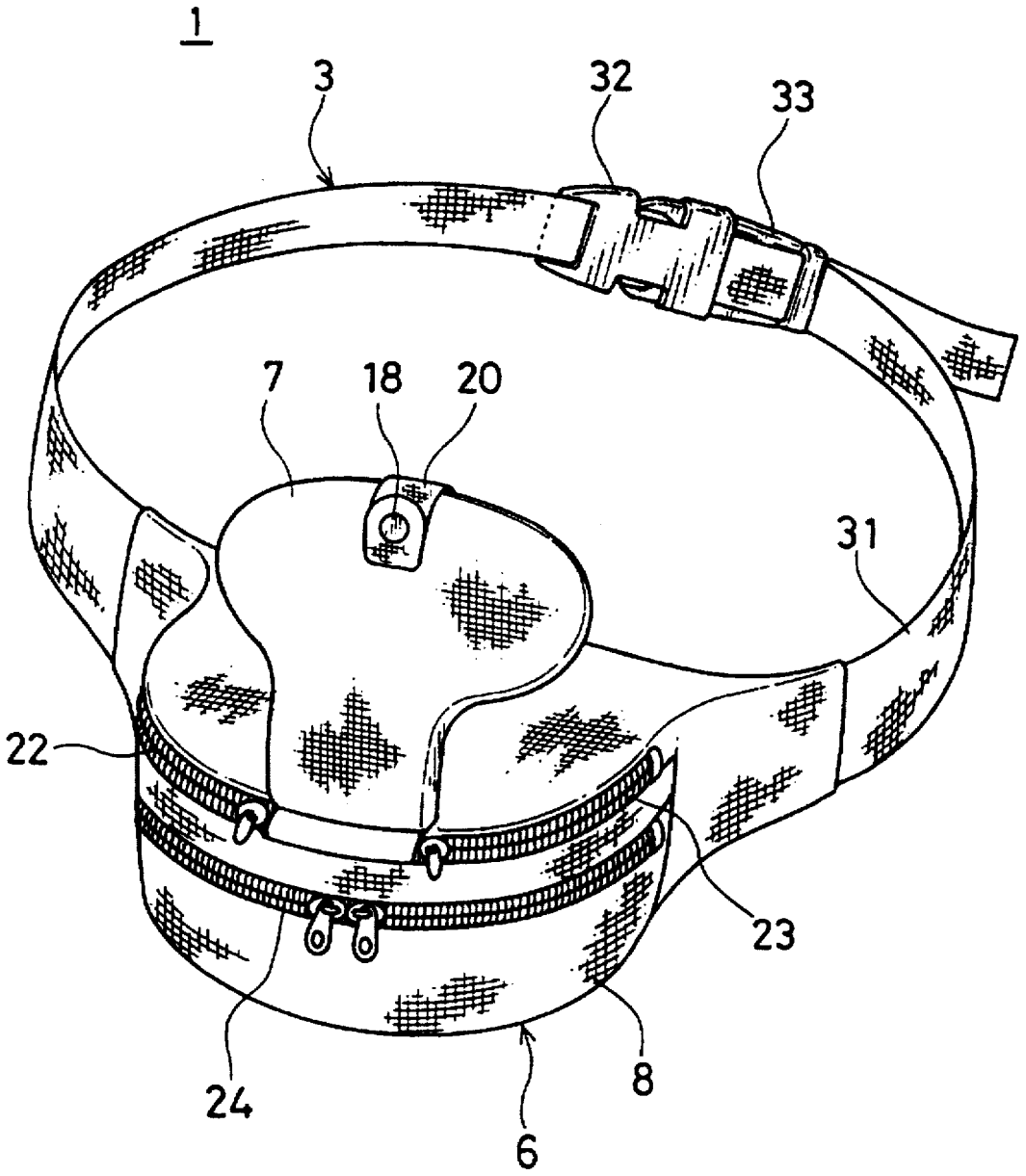
FIG. 2 is a perspective view corresponding to FIG. 1, with a pad wall 7 tilted upright from a seat surface 6.
Figure 3:
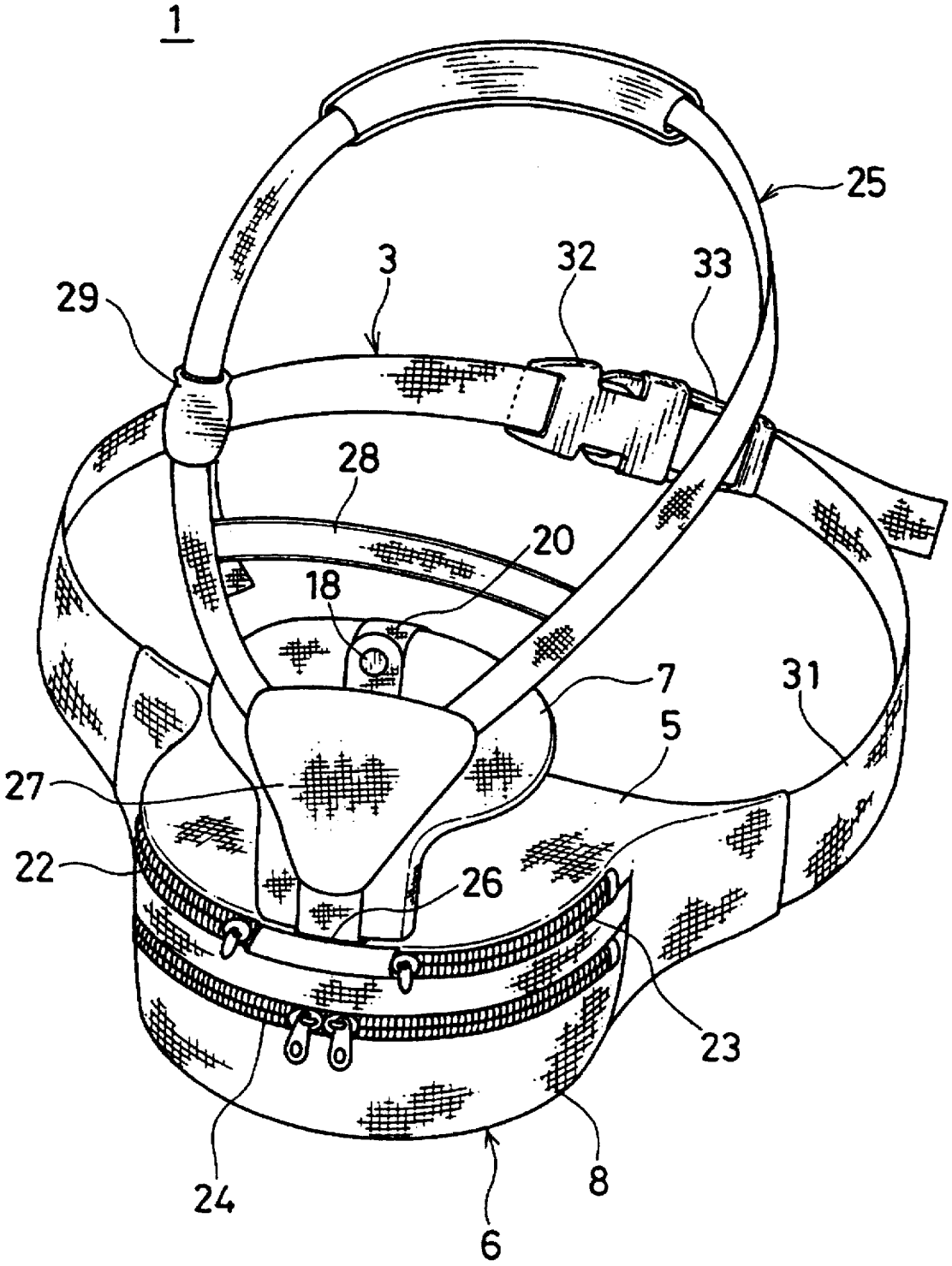
FIG. 3 is a perspective view corresponding to FIG. 1, with the pad wall 7 tilted upright from the seat surface 6 and a support strap 25 drawn out.

FIGS. 1 to 12 illustrate a baby holder 1 according to an embodiment of the present invention. FIGS. 1 to 3 are perspective views of the overall appearance of the baby holder 1, illustrating typical states assumable by the baby holder 1. On the other hand, FIGS. 4 to 7 show typical methods of using the baby holder 1.

Referring to FIGS. 1 to 3 and 4 to 7, the baby holder 1 comprises a waist strap 3 which is worn by a wearer 2 around her waist, and a support 6, which defines a seat surface 5 for receiving the buttocks of a baby 4, and which is mounted on the waist strap 3 and positioned to extend from the abdomen of the wearer 2. Further, a pad wall 7 that can be uprighted, i.e. tilted upright, from the seat surface 5 is provided on the support 6, as a structure characterizing the present invention.

Figure 4:
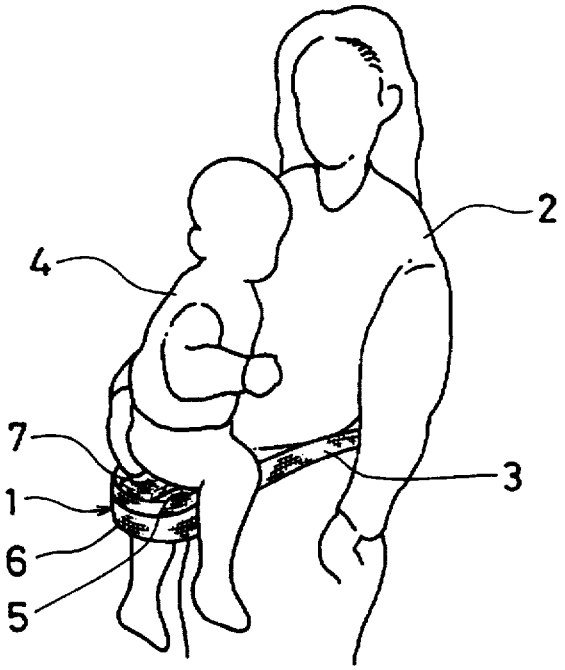
FIG. 4 illustrates a state of holding a baby 4 backward on the baby holder 1 in the state shown in FIG. 1.

According to this embodiment, the pad wall 7 has a T-shaped front surface. This pad wall 7 is rotatably mounted on the support 6. Thus, the pad wall 7 can selectively assume a state extending along the seat surface 5 as shown in FIGS. 1 and 4, and a state uprighted, i.e. extending upright, from the seat surface 5 as shown in FIGS. 2, 3 and 5 to 7 respectively. The pad wall 7 extends upright from the seat surface 5 at an angle of about 100°, for example.

With reference to FIGS. 1 to 7 as well as to FIGS. 8 to 12, the baby holder 1 is now described in more detail.

Figure 8:
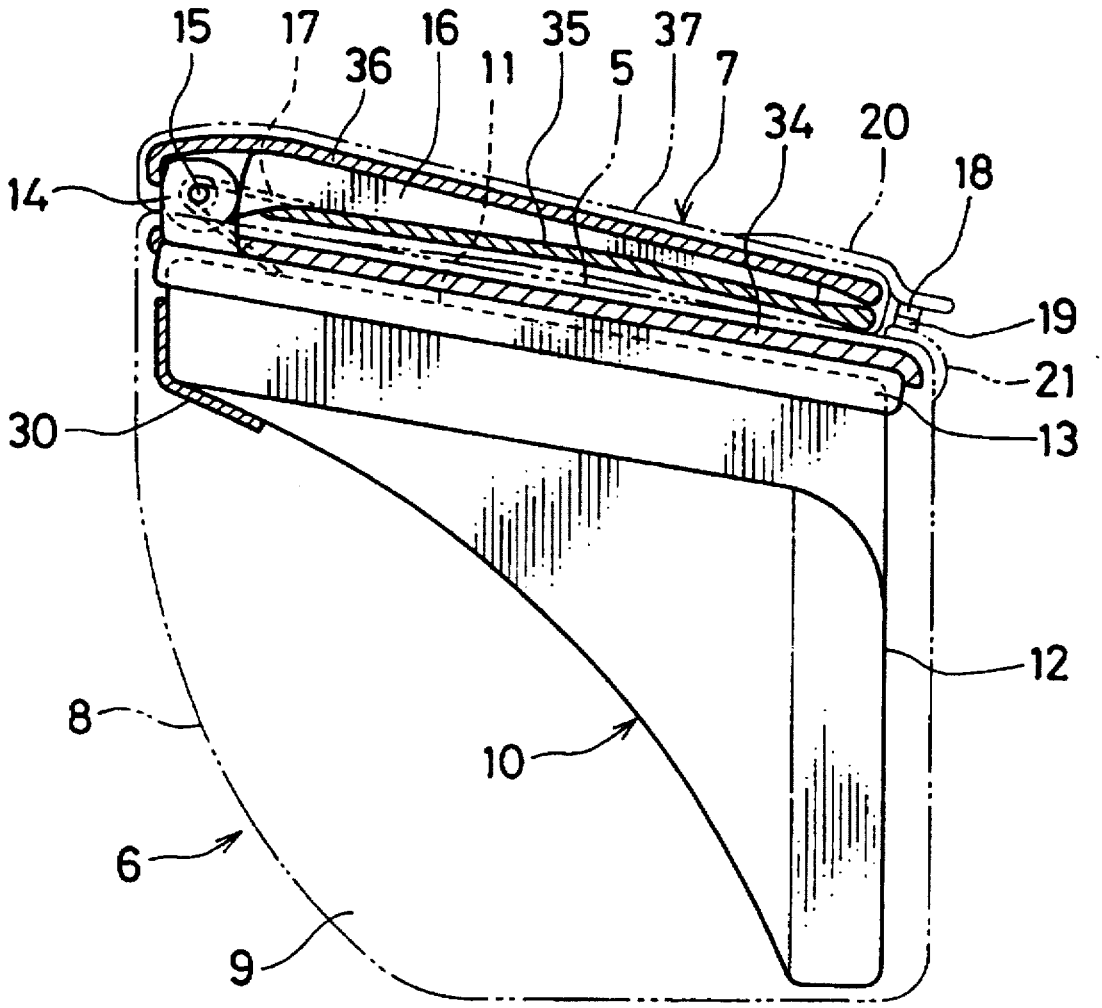
FIG. 8 is a partially sectioned side elevational view showing the internal structure of a support 6 of the baby holder 1 and the pad wall 7.
Figure 9:
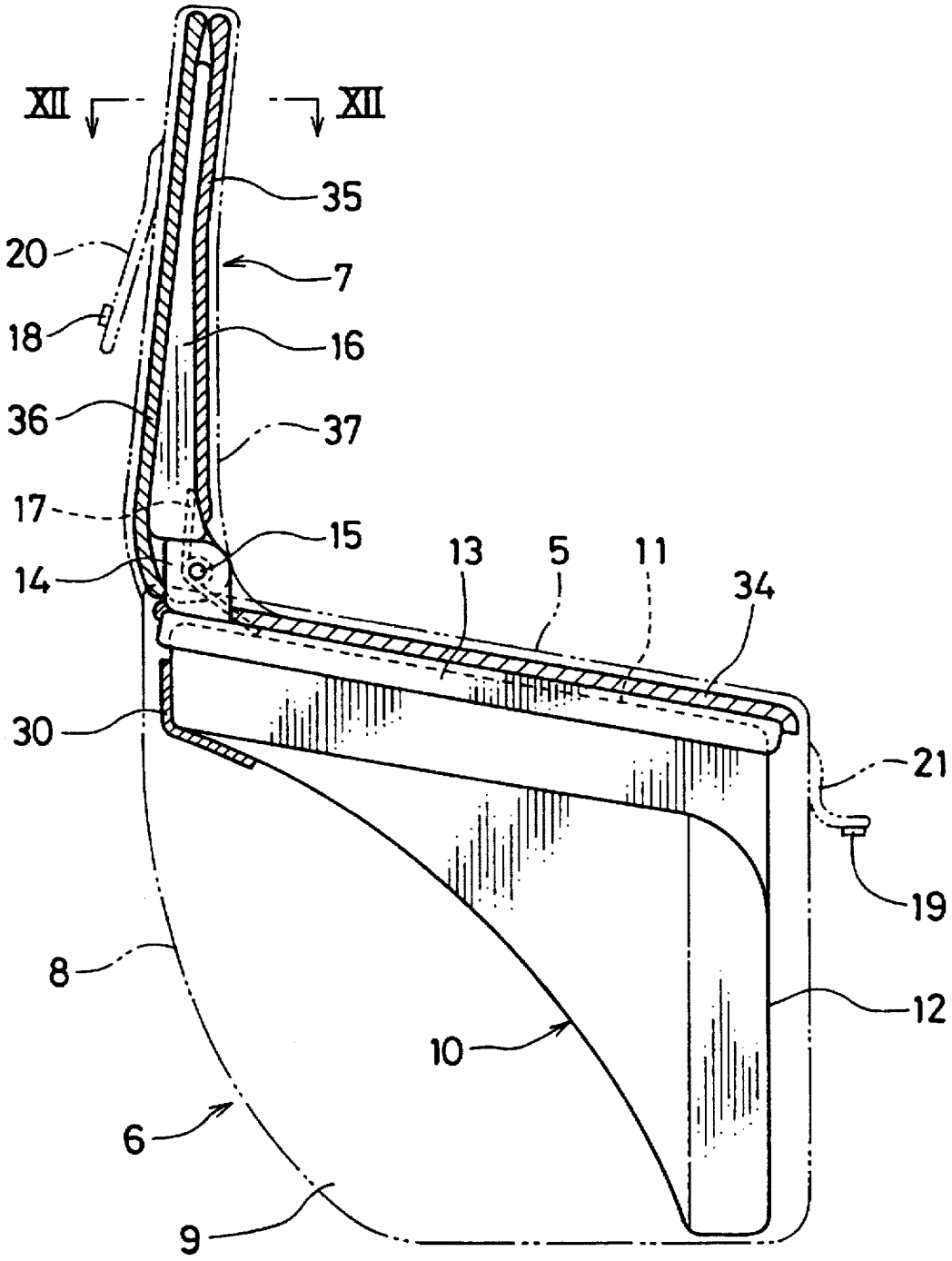
FIG. 9 is a partially sectioned side elevational view corresponding to FIG. 8, showing the pad wall 7 tilted upright from the seat surface 5.
Figure 10:
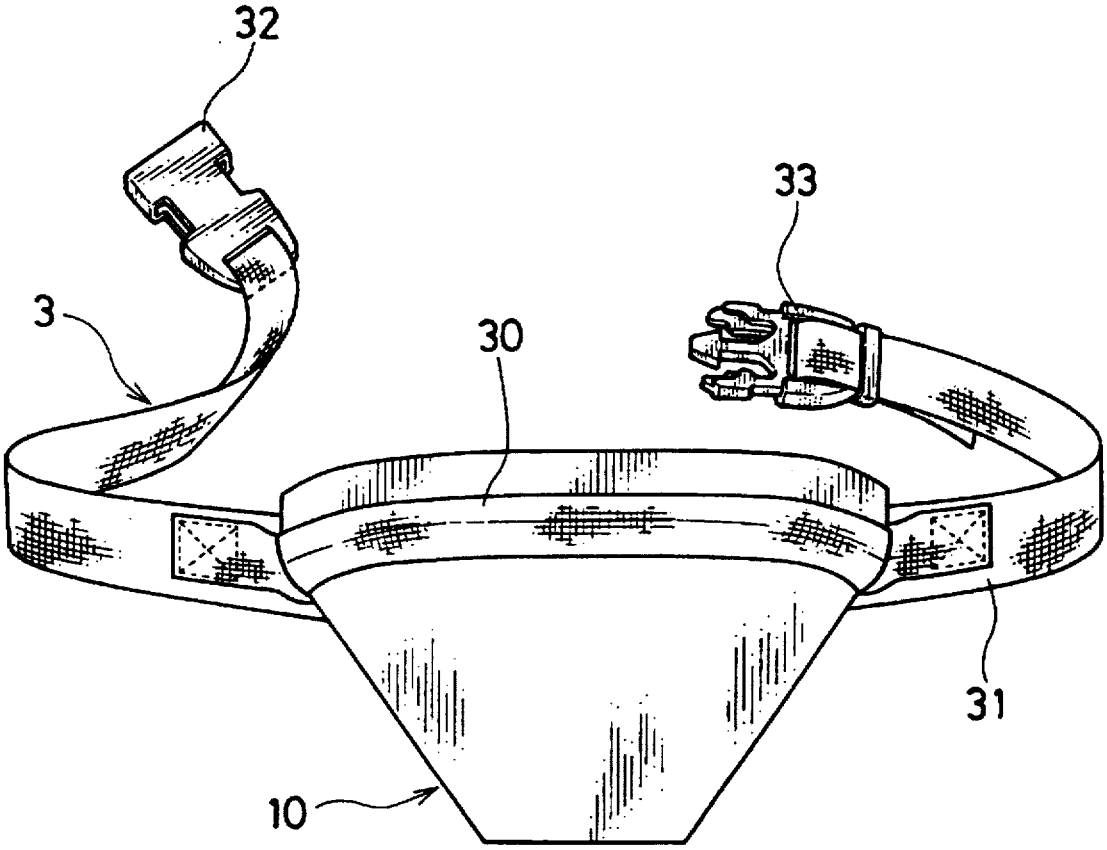
FIG. 10 is a front elevational view showing a holding core 10 arranged in the support 6 and a waist strap 3.
Figure 11:
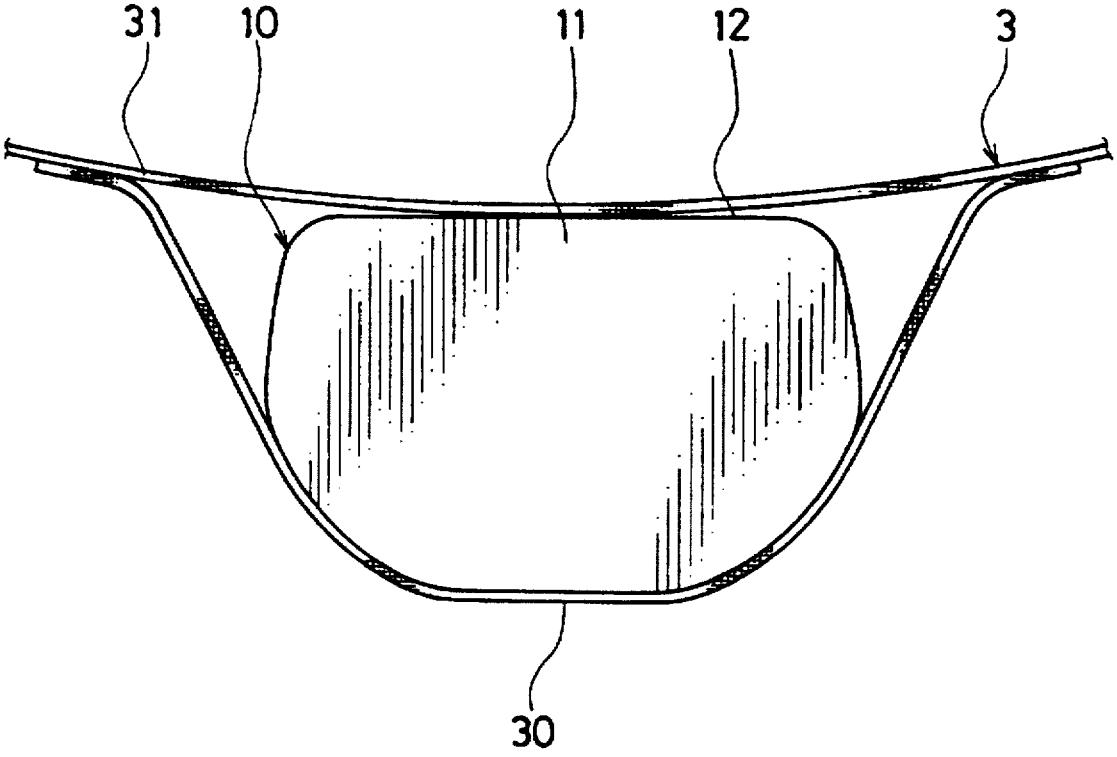
FIG. 11 is an opened or sectioned top plan view showing the holding core 10 and the waist strap 3.

FIGS. 8 and 9 are sectional side elevational views showing the internal structure of the support 6. The support 6 is preferably covered with a bag 8. This bag 8 defines a space 9 in its interior, and a holding core 10 for providing or maintaining the support 6 with an arbitrary shape is stored or arranged in this space 9. The holding core 10 is formed by a molding of foam resin, for example, for providing sufficient rigidity despite its lightness. The holding core 10 forms an upper surface 11 extending in parallel with the seat surface 5 and a rear surface 12 extending along the abdomen of the wearer 2, so that a substantially horizontal plane can be retained on the seat surface 5 when the support 6 comes into contact with the abdomen of the wearer 2. Preferably, the upper surface 11 and the rear surface 12 of the holding core 10 intersect with each other at an obtuse angle of about 100", for example. FIGS. 10 and 11 also illustrate the holding core 10.

A cover member 13 made of hard resin, for example, is fixed to the upper surface 11 of the holding core 10. A bracket 14 is formed on the front end of the cover member 13, and an axis 15 passing through this bracket 19 rotatably supports a pad core 16 for keeping the pad wall 7 in shape. When the pad wall 7 is tilted upright, a part of the pad core 16 comes into contact with a part of the bracket 14, thereby defining the terminal end of rotation of the pad core 16. The pad core 16, which is adapted to provide sufficient rigidity for the pad wall 7, is made of hard resin, for example. Thus, the pad wall 7 is rotatably held with respect to the support 6. The cover member 13 may be integrally molded with the holding core 10, or may be inserted in a mold for molding the holding core 10.

A torsion spring 17 is arranged around the aforementioned axis 15. This torsion spring 17 urges the pad wall 7 for rotating and tilting the pad wall V upright from the seat surface 5. The torsion spring 17 may be replaced with a coil spring, or another elastic member such as a rubber member, for example.

A pair of hooks or snaps 18 and 19 are provided for maintaining the pad wall 7 in the state extending along the seat surface 5, against the elasticity of the torsion spring 17 which tends to urge the pad wall 7 upright as described above. The hook or snap 18 is mounted on an end portion of a strap 20 extending from the pad wall 7, while the other hook or snap 19 is mounted on an end portion of another strap 21 extending from the support 6. When the hook or snap 18 engages with the hook or snap 19 as shown in FIG. 8, the pad 7 is maintained in the state extending along the seat surface 5, regardless of the elasticity of the torsion spring 17. The hooks or snaps 18 and 19 may be replaced with other fastener members such as velvet fasteners, for example.

The aforementioned space 9 in the bag 8 is sized to be capable of storing articles other than the holding core 10. This space 9 can be used for storing small articles such as a handkerchief, tissue paper and the like, for example. As shown in FIGS. 1 to 3, openable slide fasteners 22, 23 and 24 are provided on the bag 8, for giving facility in taking such small articles in and out.

Figure 7:
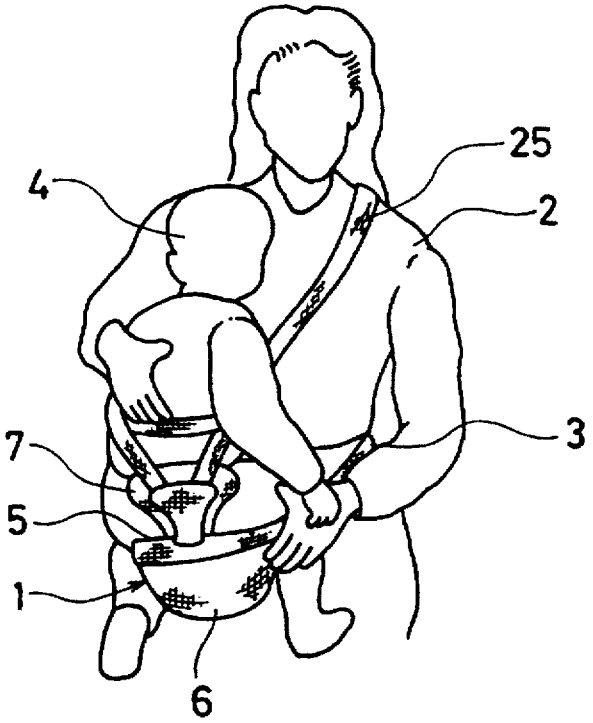
FIG. 7 is a diagram corresponding to FIG. 4, illustrating a state of holding the baby 4 backward on the baby holder 1 in the state shown in FIG. 3.

The baby holder 1 further comprises a support strap 25, as shown in FIGS. 3 and 7. This support strap 25 is stored in the space 9 of the bag 8 when the same is not being used. On the other hand, the support strap 25 is drawn out from an opening 26 between the slide fasteners 22 and 23. The support strap 25 forms a loop as a whole, and a pad part 27 having a relatively wide area is provided on its base portion. Further, a bridge strap part 28 is formed in the vicinity of the pad part 27, for coupling respective side portions of the support strap 25 with each other. The effective length of the support strap 25 is preferably rendered adjustable, and a length adjusting mechanism 29 is provided for this purpose, although this mechanism is not illustrated in detail.

FIGS. 10 and 11 are a front elevational view and a top plan view for illustrating the relation between the support 6, particularly the holding core 10, and the waist strap 3 respectively. The waist strap 3 comprises a front strap part 30 and a rear strap part 31 passing around or along the front and rear surfaces of the holding core 10 respectively. The front and rear strap parts 30 and 31 are coupled with each other on both sides of the holding core 10.

The front strap part 30 is fixed to a relatively upper position of the front surface of the holding core 10. This fixation is attained by an adhesive or rivets (not shown), for example. Thus, the holding core 10 is fixed by the front strap part 30 on its front side, whereby the attitude of the holding core 10 is stabilized for inhibiting the seat surface 5 from being so inclined that its front part is undesirably lowered. Thus, the seat surface 5 can be properly kept in a horizontal state. On the other hand, the rear strap part 31 may or may not be fixed to the holding core 10.

A buckle 32 and a tip 33 which are engageable with each other are mounted on respective end portions of the waist strap 3, to be coupled with each other when the wearer 2 wears the waist strap 3 around her waist. As shown in FIG. 10, the tip 33 can be mounted on an arbitrary position of the waist strap 3, thereby also serving a function of adjusting the effective length of the waist strap 3. Alternatively, the buckle 32 and the tip 33 may be replaced with other types of strap coupling members.

In the present embodiment, the rear strap part 31 forms the principal part of the waist strap 3 so that the buckle 32 and the tip 33 are mounted on the end portions of the rear strap part 31, and both end portions of the front strap part 30 are connected to the rear strap part 31. However, as an alternative, the front strap part 30 may form the principal part of the waist strap 3 so that the buckle 32 and the tip 33 are mounted on the end portions of the front strap part 30 respectively, and both end portions of the rear strap part 31 are connected to the front strap part 30. Further, both of the front and rear strap parts 30 and 31 may extend toward the positions of the buckle 32 and the tip 33. Further, the waist strap 3 may be formed only by the front strap part 30 with no rear strap part 31 so that the buckle 32 and the tip 33 are mounted on the end portions of the front strap part 30 respectively.

Figure 12:
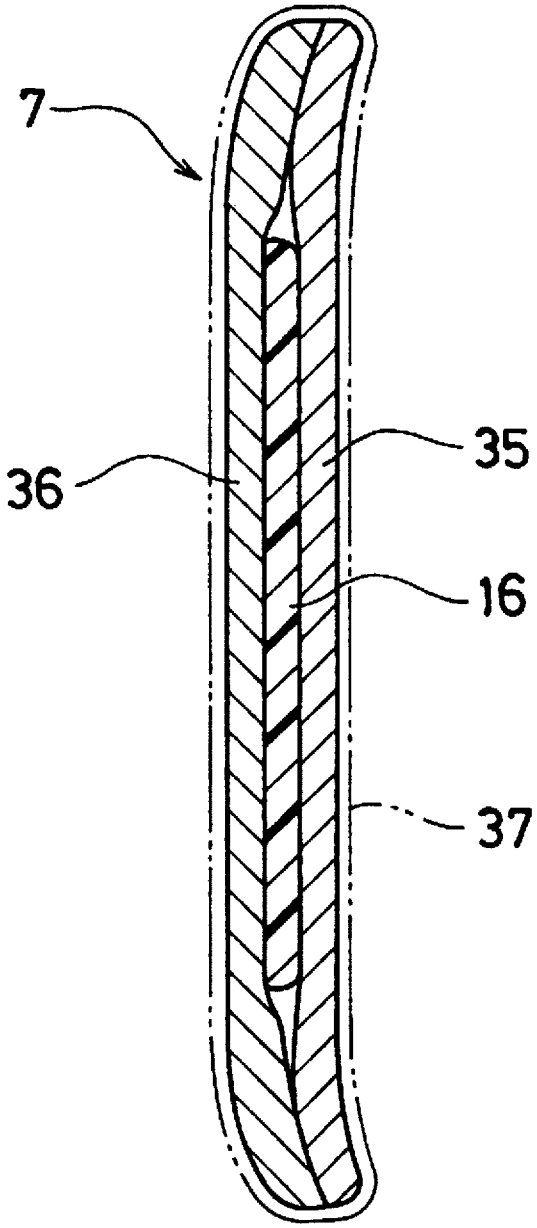
FIG. 12 is a sectional end view showing a cut portion taken along the line XII—XII in FIG. 9.

Referring again to FIGS. 8 and 9, cushion members 34, 35 and 36 are arranged to cover the upper surface of the cover member 13 and both surfaces of the pad core 16 respectively. These cushion members 34, 35 and 36 are made of urethane foam or cotton, for example. The cushion member 34 is covered with the bag 8, and provides a soft touch for the seat surface 5. FIG. 12 also shows the cushion members 35 and 36 and the pad core 16. FIG. 12 is a sectional end view showing a cut portion taken along the line XII—XII in FIG. 9. The cushion members 35 and 36 are covered with a surface sheet 37 of the pad wall 7, and provide a soft touch for both surfaces of the pad wall 7.

As clearly understood from FIG. 12, the upper surface of the pad wall 7 is so shaped that both end portions thereof are curved to approach the wearer 2. Thus, the pad wall 7 can further fit the body of the baby 4, for more stably supporting the baby 4. While the aforementioned curved shape is provided by the cushion members 35 and 36 in this embodiment as shown in FIG. 12, both end portions of the pad core 16 may alternatively be curved thereby providing the pad wall 7 with the curved shape. A method of using this baby holder 1 is now described. FIGS. 4 to 7 respectively illustrate typical use modes of the baby holder 1. The baby holder 1 can be configured in any one of the states shown in FIGS. 1 to 3 when it is being used for carrying a baby in each of the modes shown in FIGS. 4 to 7.

The state shown in FIG. 1 is employed when the wearer 2 simply wears the baby holder 1. In this state, the pad wall 7 is reclined or tilted down to extend along the seat surface 5, to reduce the bulk of the baby holder 1. The hooks or snaps 18 and 19 engage with each other as shown in FIG. 8, to maintain the pad wall 7 in this state.

In the aforementioned state, the support 6 may be employed as a temporary stay for holding the baby 4 backward. While the buttocks of the baby 4 are placed on the pad wall 7 in this case, the pad wall 7 which is fitted with the cushion member 36 along its outer surface can provide a soft touch for the baby 4.

Figure 5:
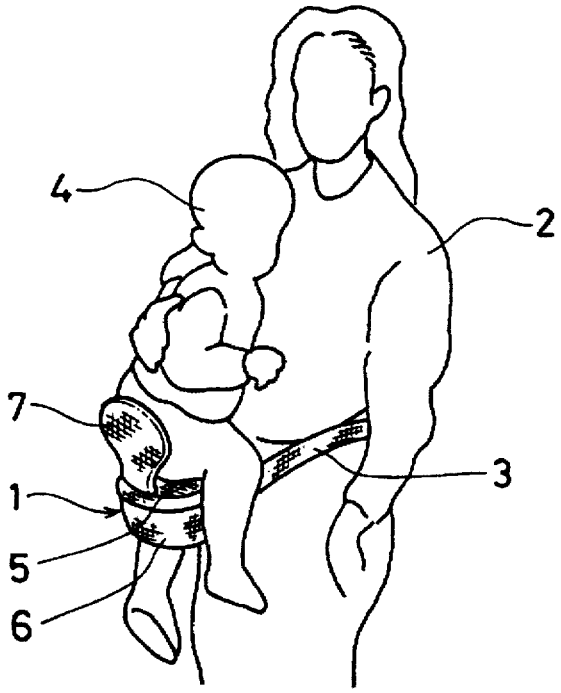
FIG. 5 is a diagram corresponding to FIG. 4, illustrating a state of holding the baby 4 backward on the baby holder 1 in the state shown in FIG. 2.
Figure 6:
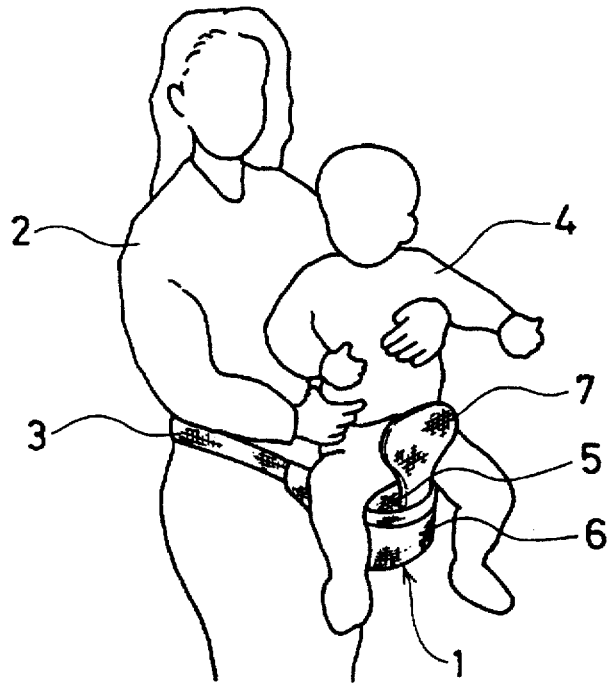
FIG. 6 is a diagram corresponding to FIG. 4, illustrating a state of holding the baby 4 facing forward on the baby holder 1 in the state shown in FIG. 2.

When the hooks or snaps 18 and 19 are disengaged from each other, on the other hand, the pad wall 7 is tilted upright from the seat surface 5, as shown in FIG. 2. In this state, the support 6 is employed as a stay for holding the baby 4 backward as shown in FIG. 5 or forward as shown in FIG. 6. In this case, the pad wall 7 provides a backrest surface for the baby 4 in the state shown in FIG. 5, or serves as positioning means between the legs of the baby 4 in the state shown in FIG. 6. The pad wall 7, which has a T-shaped front surface as described above, provides a relatively wide surface on its upper portion for supporting the baby 4, and provides a narrower surface on its lower portion for allowing a natural arrangement of both legs of the baby 4 who is seated to face the pad wall 7 as shown in FIG. 6.

Each of the aforementioned modes shown in FIGS. 5 and 6 is preferably limited to a relatively short time. When this baby holder 1 is employed for supporting the baby 4 over a relatively long time, the support strap 25 is drawn out from the support 6 as shown in FIG. 3, and the baby 4 is placed on the support 6 backward as shown in FIG. 7, so that the wearer 2 wears the support strap 25 on the shoulder. Thus, the baby 4 can be stably held over a relatively long time with the help of the support strap 25 as well as the pad part 27 and the bridge strap part 28 provided thereon in addition to the pad wall 7.

In any of the states shown in FIGS. 4 to 7, it is advisable to lay at least one hand of the wearer 2 on the body of the baby 4, in order to improve safety for the baby 4.

Figure 13A:
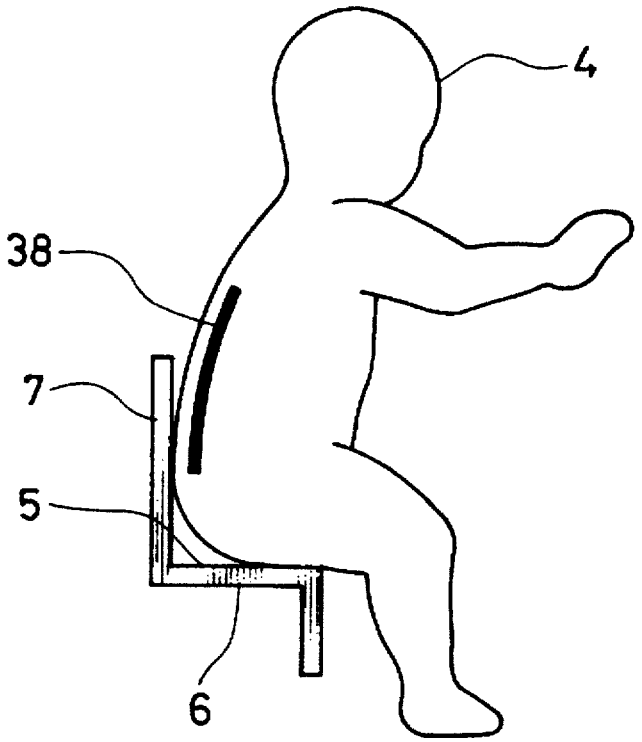
FIG. 13A is an illustrative side elevational view showing a state of the backbone 38 of the baby 4 supported by the pad wall 7.
Figure 13B:
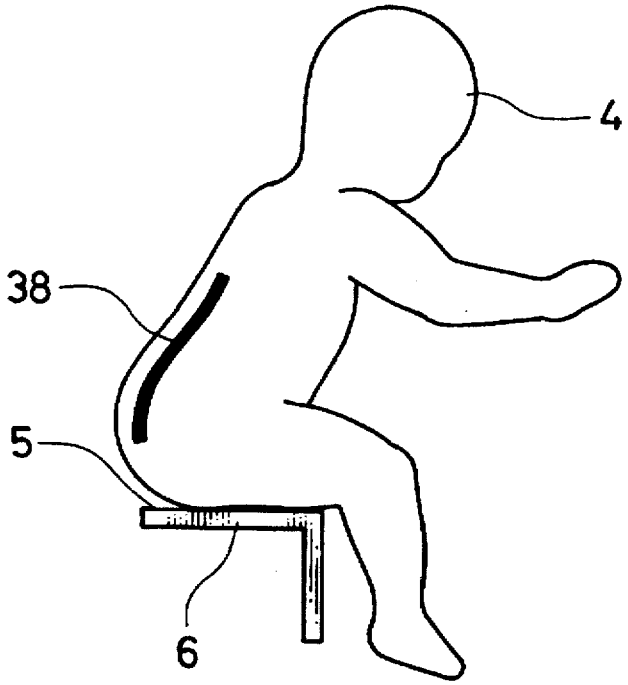
FIG. 13B is an illustrative side elevational view showing a state of the backbone 38 of the baby 4 not being supported by a pad wall.

FIGS. 13A and 13B are illustrative side elevational views showing states of the backbone 38 of the baby 4 supported by the pad wall 7 (FIG. 13A) and not supported by a pad wall (FIG. 13B) respectively. When no pad wall is provided as shown in FIG. 13B, the backbone 38 of the baby 4 may be abnormally curved to exert a bad influence on the health of the baby 4 unless the wearer 2 or person carrying the baby sufficiently pays attention to the baby's posture. When the back of the baby 4 is supported by the pad wall 7 as shown in FIG. 13A, on the other hand, the backbone 38 can be protected against abnormal curvature, and the baby 4 can be readily kept in a good posture. Further, the pad wall 7 also functions to prevent the buttocks of the baby 4 from slipping off the seat surface 5, thereby stably positioning the buttocks of the baby 4 on the seat surface 5.

FIGS. 14 to 28 show other embodiments of the present invention respectively. Referring to FIGS. 14 to 28, elements corresponding to those shown in FIGS. 1 to 13 are denoted by similar reference numerals, and a redundant description thereof is omitted.

Figure 14:
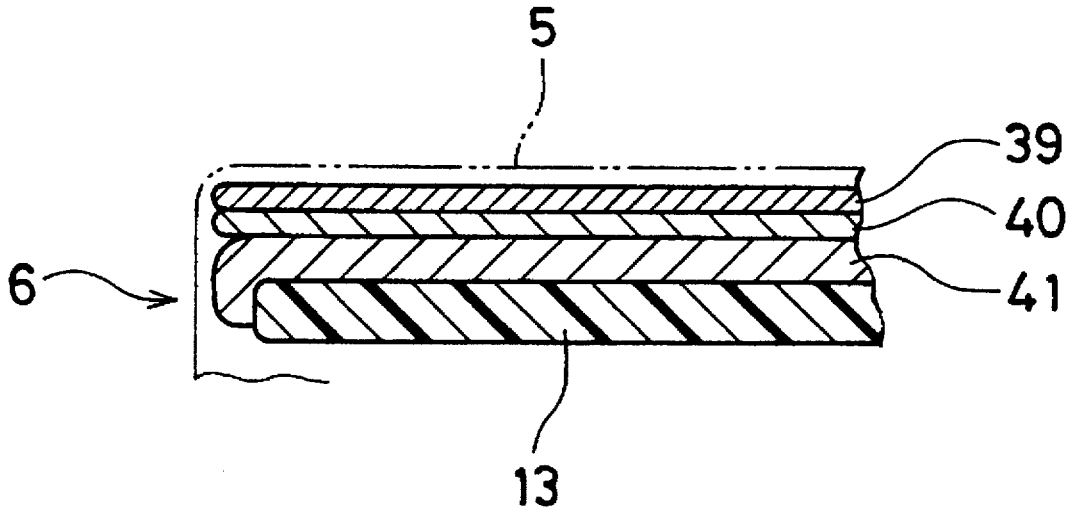
FIG. 14 is a sectional view showing a part of a seat surface 5 of a support 6 provided on a baby holder according to another embodiment of the present invention.

FIG. 14 is a sectional view showing a seat surface 5 and parts of structures related thereto. In place of the cushion member 34 in the aforementioned embodiment, a three-layer structure consisting of a first cushion member 39, a second cushion member 40 which is arranged at the back thereof, and a third cushion member 41 which is further arranged at the back thereof is applied in this embodiment. The second cushion member 40 has a larger elastic coefficient than the first cushion member 39, while the third cushion member 41 has a larger elastic coefficient than the second cushion member 40. In more concrete terms, materials employed for the first, second and third cushion members 39, 40 and 41 respectively may be a combination of urethane foam, urethane chips and a polyethylene bead foam for the first cushion member 39, a combination of cotton, urethane foam and polystyrene foam for the second cushion member 40, and a combination of cotton, urethane foam and urethane chips for the third cushion member 41, or the like.

According to such a cushion structure including the three layers of cushion members 39, 40 and 41, substantially only the first cushion member 39 deforms in an ordinary state so that a preferable soft touch can be provided for the baby while the second and third cushion members 40 and 41 successively serve as shock absorbers against a strong shock, whereby high reliability can be expected with respect to shock absorptivity, and the safety of the baby holder can be further improved.

The aforementioned three-layer structure can also be applied to the cushion members 35 and 36 which are provided in the pad wall 7 (see FIGS. 8, 9 and 12) so that an effect similar to the above can be expected, although this structure is not shown.

Figure 15:
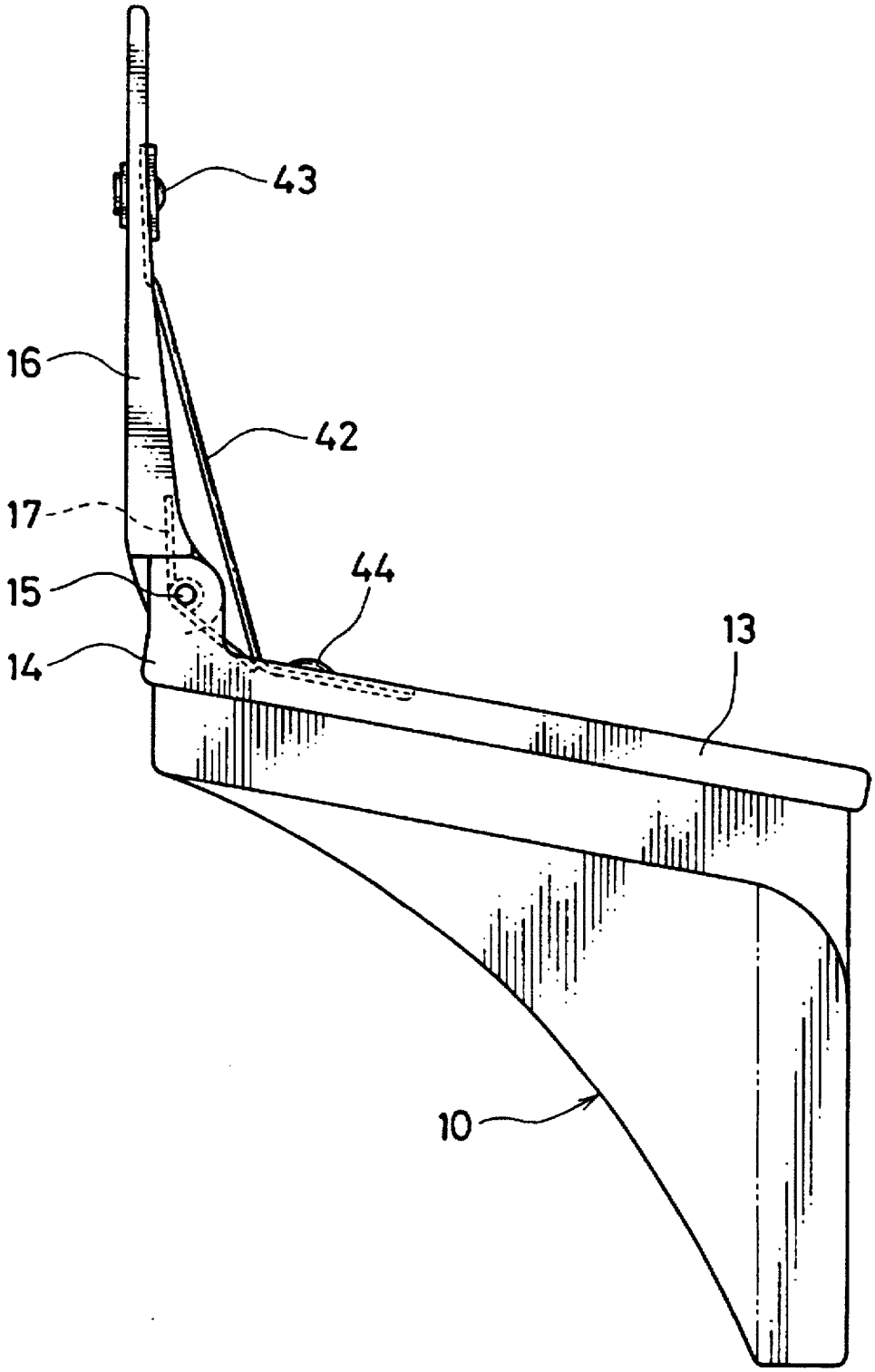
FIG. 15 is a side elevational view showing a pad core 16 and a cover member 13 in a baby holder according to still another embodiment of the present invention.

As shown in FIG. 15, a tension belt 42 may be arranged for coupling a pad core 16 and a cover member 13 with each other in order to further reliably and positively define the terminal end of rotation of the pad core member 16 when it reaches its upright position. Ends of the tension belt 42 are mounted on the pad core 16 and the cover member 13 by rivets 43 and 44 respectively.

Figure 16:
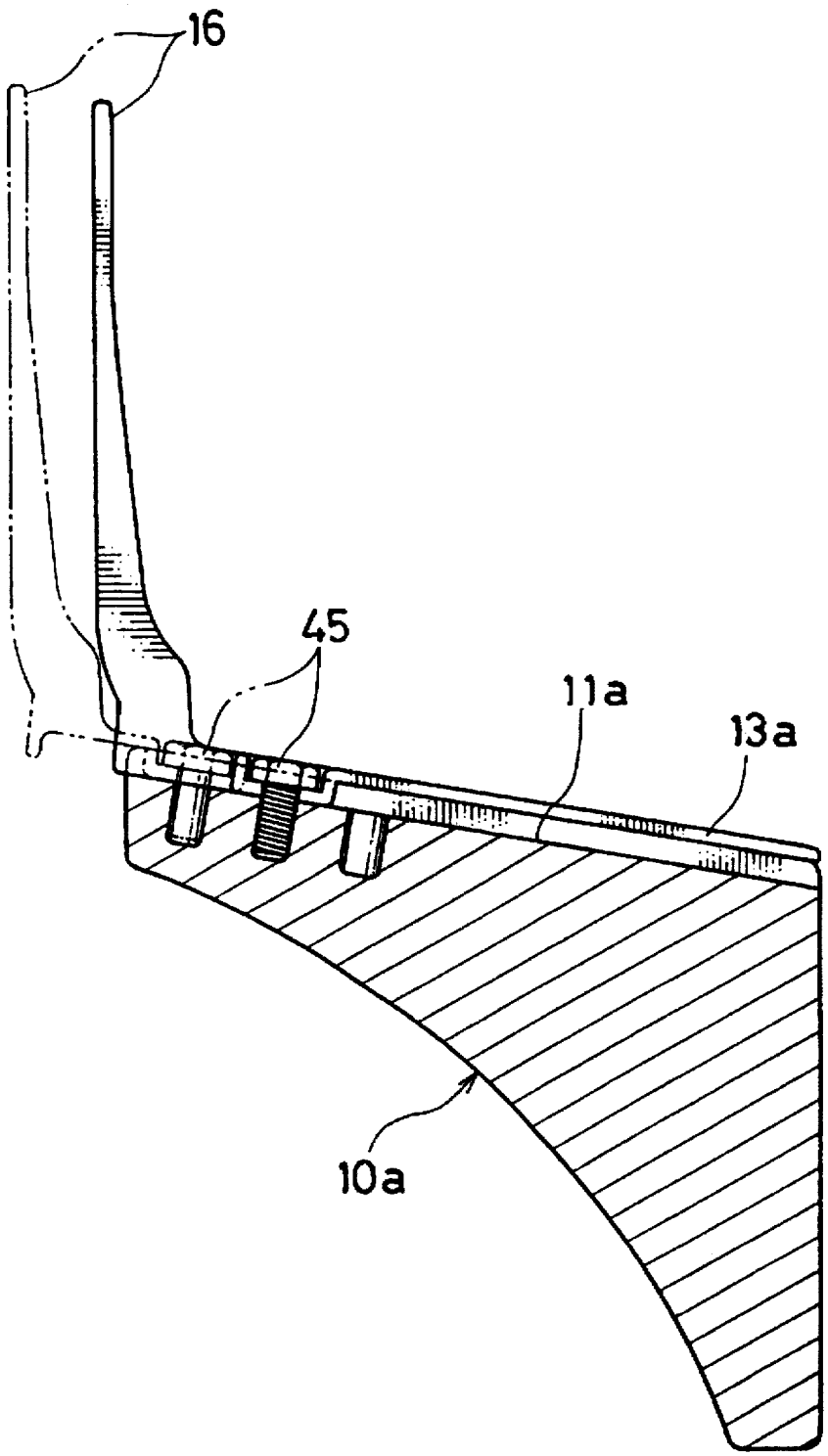
FIG. 16 is a partially broken open and sectioned side elevational view showing a pad core 16 and a holding core **10*a*** in a baby holder according to a further embodiment of the present invention.
Figure 17:
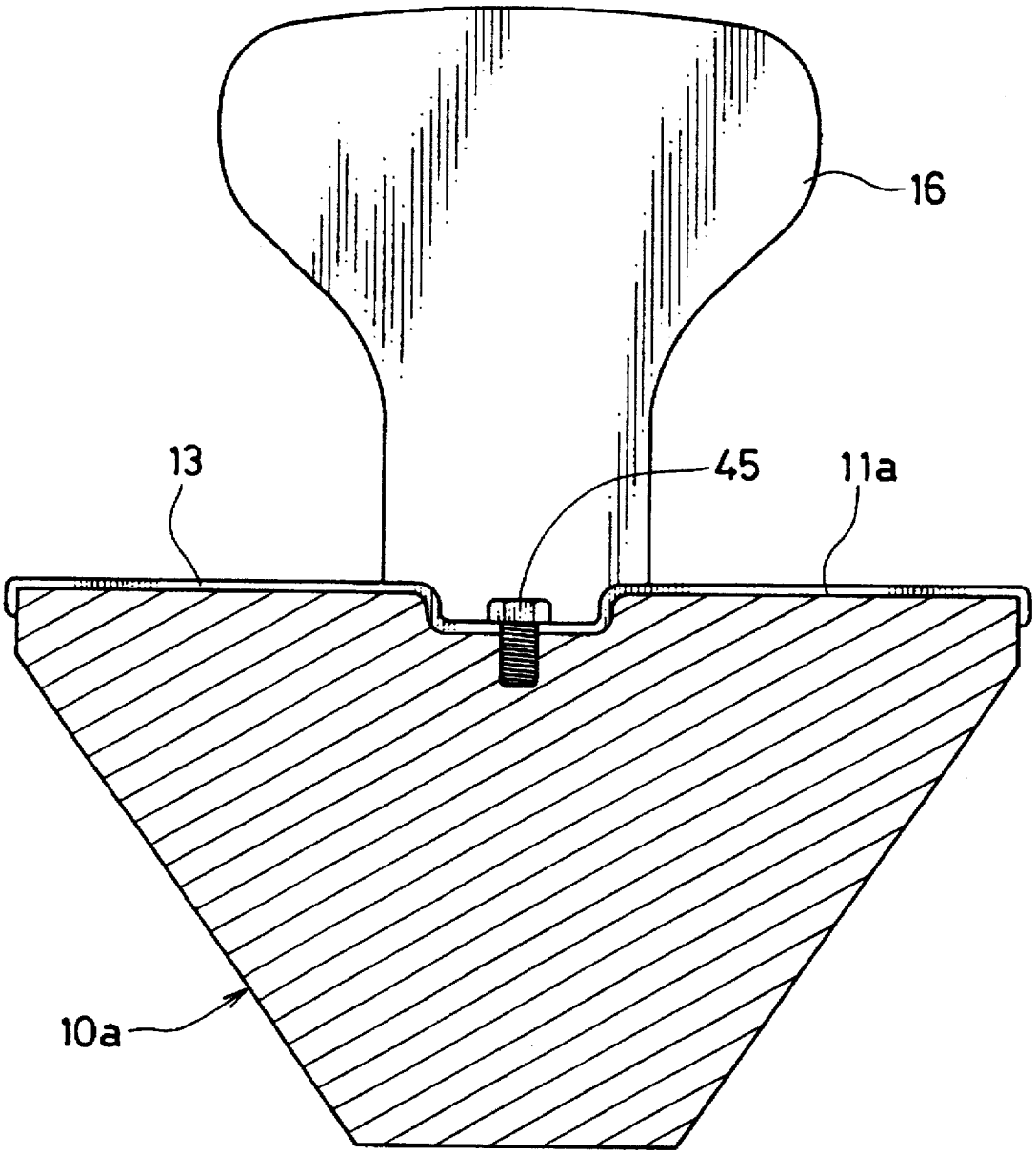
FIG. 17 is a partially sectioned rear elevational view showing the pad core 16 and the holding core **10*a* shown in FIG. 16**.

As shown in FIGS. 16 and 17, on the other hand, a pad core 16 may be rendered horizontally movable, thereby controlling the horizontal position of a pad wall 7. Namely, a cover member **13*a* mounting the pad core 16 is rendered horizontally movable along an upper surface 11*a* of a holding core 10*a*, and can be fixed by a bolt 45** in each position obtained as a result of such movement.

The horizontal position of the pad wall 7 is thus rendered controllable, whereby the position of the pad wall 7 can be adjusted as the baby grows. According to this embodiment, the pad wall 7 can be removed from a support by unfastening the bolt 45. When the pad wall 7 is not used over a relatively long period, this pad wall 7 can be removed to further reduce the bulk of the baby holder.

Figure 18:
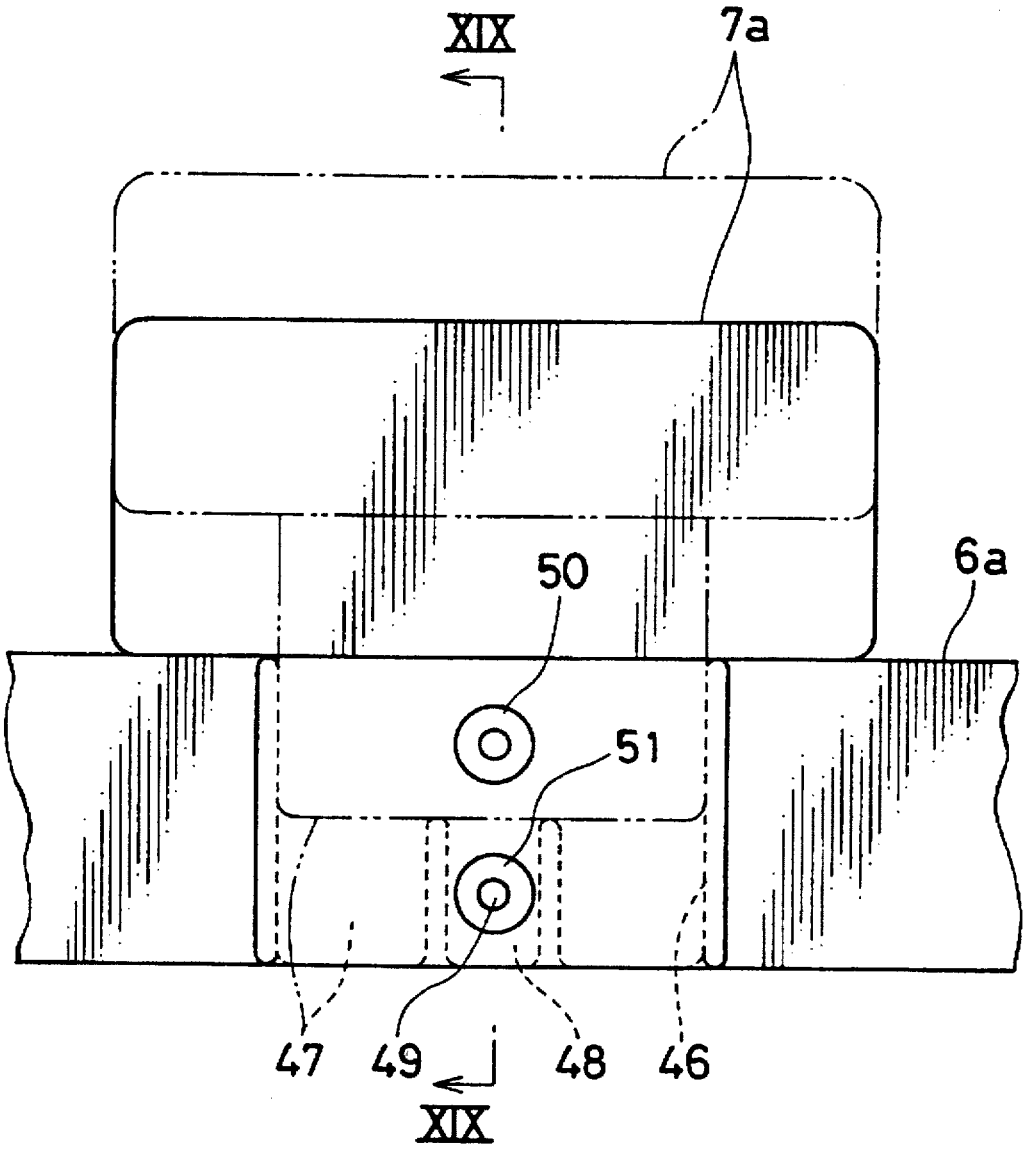
FIG. 18 is a front elevational view showing a support **6*a* and a pad wall 7*a*** provided on a baby holder according to a further embodiment of the present invention.
Figure 19:
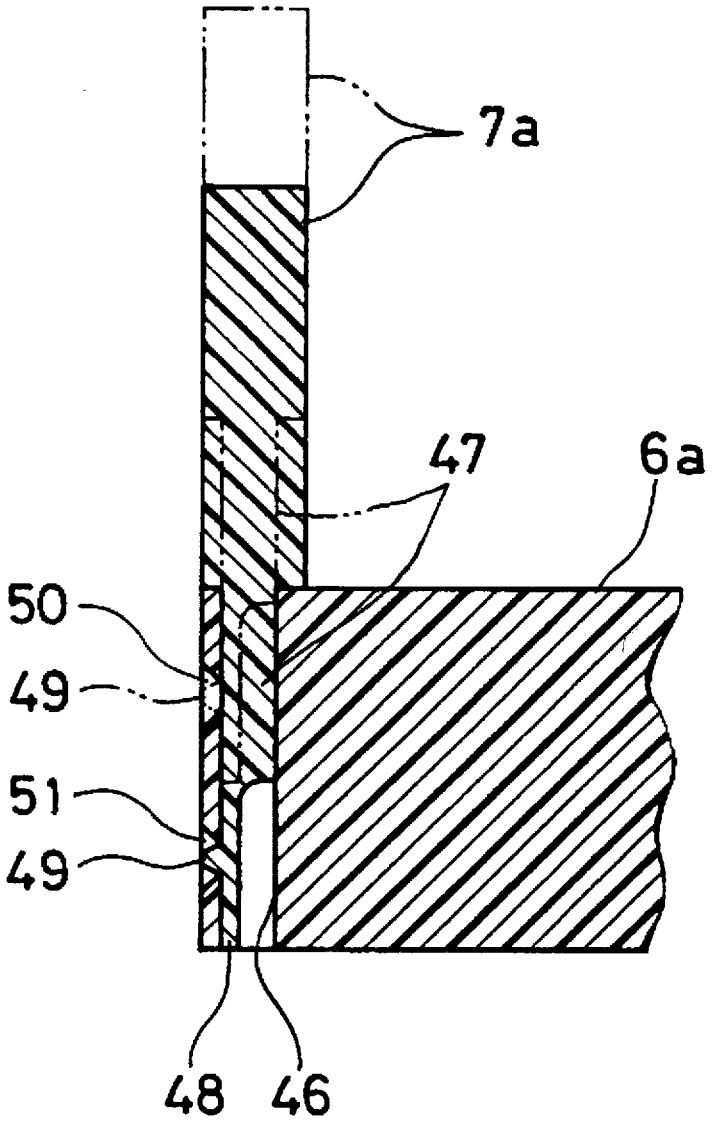
FIG. 19 is a sectional view taken along the line XIX—XIX in FIG. 18.
Figure 20:
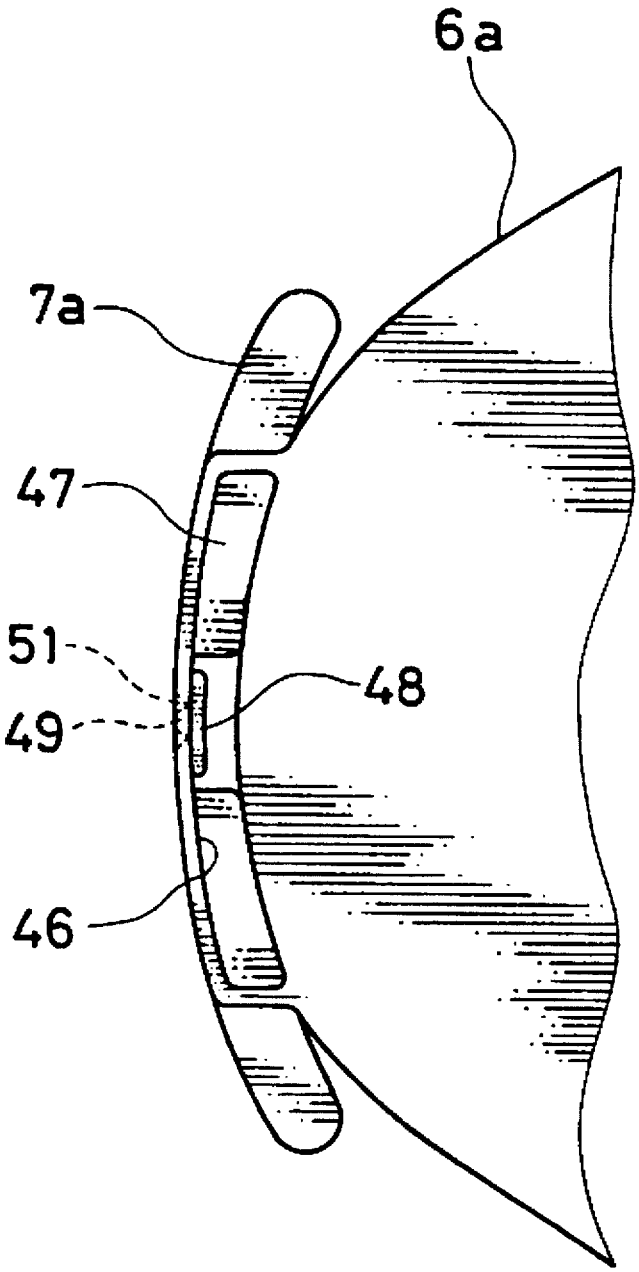
FIG. 20 is a bottom plan view showing the support **6*a* and the pad wall 7*a* shown in FIG. 18**.

As shown in FIGS. 18 to 20, a pad wall 7 a may be rendered vertically movable with respect to a support 6*a*, so that its height is controllable. FIGS. 18, 19 and 20 are a front elevational view, a sectional view taken along the line XIX—XIX in FIG. 18, and a bottom plan view respectively.

Referring to FIGS. 18 to 20, the support 6*a* is provided on its front end with a guide hole or slot 46 vertically passing through the same, and a guide leg 47 downwardly extending from the pad wall 7*a* is vertically slidably received in the guide hole An elastically deformable engager 48 is provided at the center of the guide leg 47, and an engaging projection 49 is formed on the engager 48. On the other hand, a plurality of, e.g., two engaging holes 50 and 51 are vertically arranged on the support 6*a* in correspondence to the position of the engaging projection 49. Therefore, the height of the pad wall 7*a* can be controlled by inserting the engaging projection 49 in either one of the engaging holes 50 and 51.

Due to such height controllability of the pad wall 7*a*, the height of the pad wall 7*a* can be varied as the baby grows, while it is possible to prevent unnecessary bulkiness of the baby holder resulting from presence of a pad wall which is excessively high for the baby's build.

The aforementioned engaging holes 50 and 51 are preferably tapered on outer sides thereof, while the engaging projection 49 is also preferably tapered. Thus, the operation of releasing the engaging projection 49 from the engaging hole 50 or 51 is simplified, while the engaging projection 49 can readily engage with the engaging hole 50 or 51.

Also in this embodiment, the pad wall 7*a* can be removed from the support 6*a*. When the pad wall 7*a* is not used over a relatively long period, therefore, the pad wall 7*a* can be removed to further reduce the bulk of the baby holder, similarly to the aforementioned embodiment.

Figure 21:
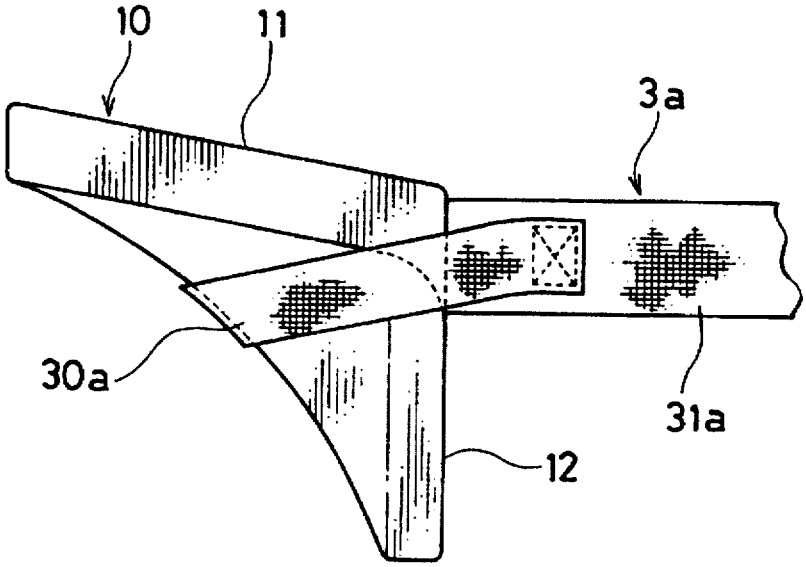

FIG. 21 is a side elevational view showing a holding core 10 and a waist strap 3*a*. The waist strap 3*a* has front and rear strap parts 30*a* and 31*a* passing along the front and rear surfaces of the holding core 10 respectively. These front and rear strap parts 30*a* and 31*a* are coupled with each other on both sides of the holding core 10, similarly to the aforementioned front and rear strap parts 30 and 31.

According to this embodiment, the front strap part 30*a* passes along a relatively lower position on the front surface of the holding core 10, and the height of this front strap part 30*a* on the front surface of the holding core 10 is selected to be lower than that of the rear strap part 31*a* on the rear surface of the holding core 10.

Due to such selection of the height of the front strap part 30*a*, the force for raising up the front end of the holding core 10 can be further strongly exerted by the front strap part 30*a*. Thus, the front strap part 30*a* can be arranged to further effectively keep a substantially horizontal attitude of a seat surface.

Figure 22:
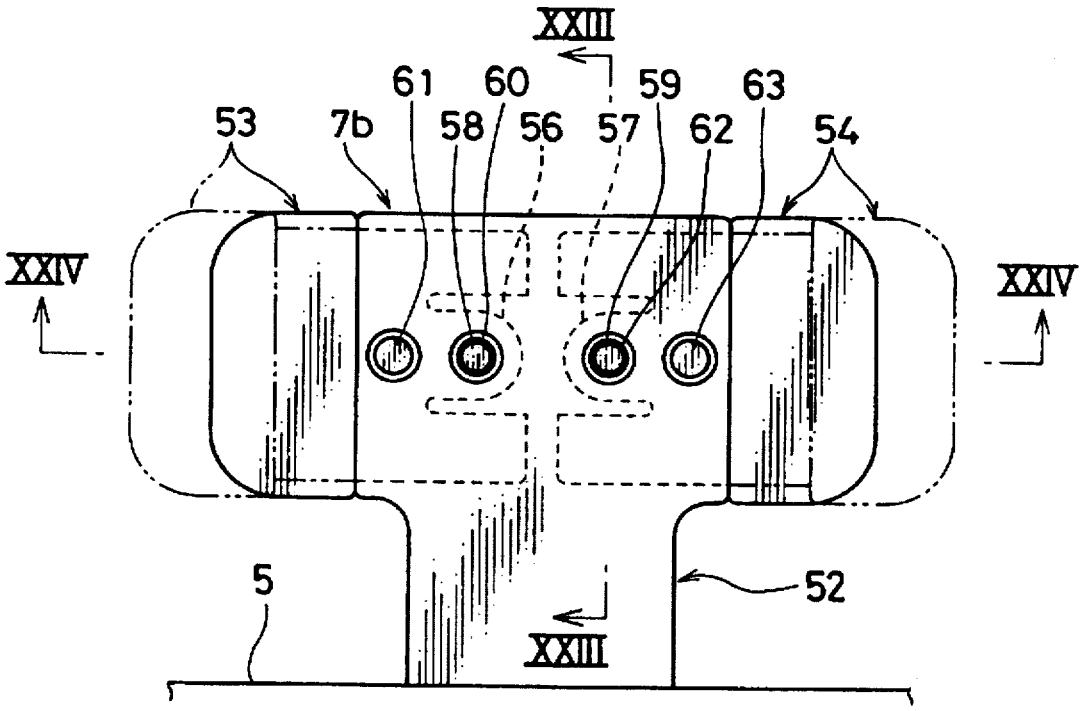
FIG. 22 is a front elevational view showing a pad wall **7*b*** provided in a baby holder according to a further embodiment of the present invention.
Figure 23:
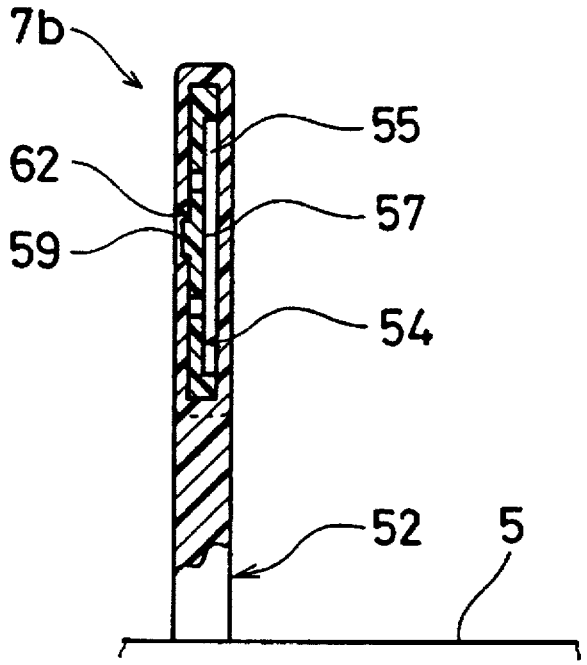
FIG. 23 is a sectional view taken along the line XXIII—XXIII in FIG. 22.
Figure 24:
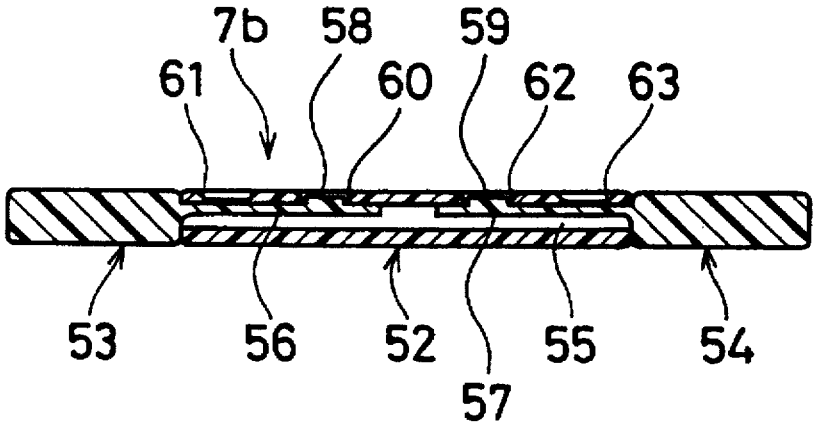
FIG. 24 is a sectional view taken along the line XXIV—XXIV in FIG. 22.

As shown in FIGS. 22 to 24, a pad wall 7*b* may be rendered adjustable in width. FIG. 22 is a front elevational view of the pad wall 7*b*, and FIGS. 23 and 24 are sectional views taken along the lines XXIII—XXIII and XXIV—XXIV in FIG. 22 respectively.

Referring to FIGS. 22 to 24, the pad wall 7*b* comprises an upright part 52 which extends upright from a seat surface 5, and wing parts 53 and 54 extending sideward from the upright part 52 respectively. The upright part 52 is provided with a through slot 55 opening on both sides thereof. The wing parts 53 and 54 are partially inserted in the through slot 55 respectively, to be movable between positions shown by solid and phantom lines in FIG. 22 respectively, while remaining partially inserted in the slot 55. The width of the pad wall 7*b* is changed by this movement.

The aforementioned upright part 52 end the wing parts 53 and 54 are resin moldings, for example. The wing parts 53 and 54 are provided with engagers 56 and 57 which are elastically deformable due to the elasticity of the resin material, and engaging projections 58 and 59 are formed on these engagers 56 and 57 respectively. On the other hand, the upright part 52 is provided with a plurality of, e.g., two engaging holes 60 and 61 which are transversely aligned with each other in correspondence to the position of the engaging projection 58, as well as a plurality of, e.g., two engaging holes 62 and 63 which are transversely aligned with each other in correspondence to the position of the engaging projection 59.

When the engaging projections 58 and 59 engage with the engaging holes 60 and 62 respectively, therefore, the pad wall 7*b* can be maintained in a state having a relatively small width as shown by the solid lines in FIG. 22. When the engaging projections 58 and 59 engage with the engaging holes 61 and 63 respectively, on the other hand, the pad wall 7*b* can be maintained in a state having a relatively large width as shown by the phantom lines in FIG. 22.

When the pad wall 7*b* is thus rendered adjustable in width, the width of the pad wall 7*b* can be adjusted as the baby grows, while it is possible to prevent unnecessary bulkiness of the baby holder resulting from presence of a pad wall which is excessively wide for the build of the baby.

The aforementioned engaging holes 60 to 63 are preferably tapered on outer sides thereof. Thus, the operation of releasing the engaging projections 58 and 59 from the engaging holes 60 to 63 can be simplified.

Figure 25:
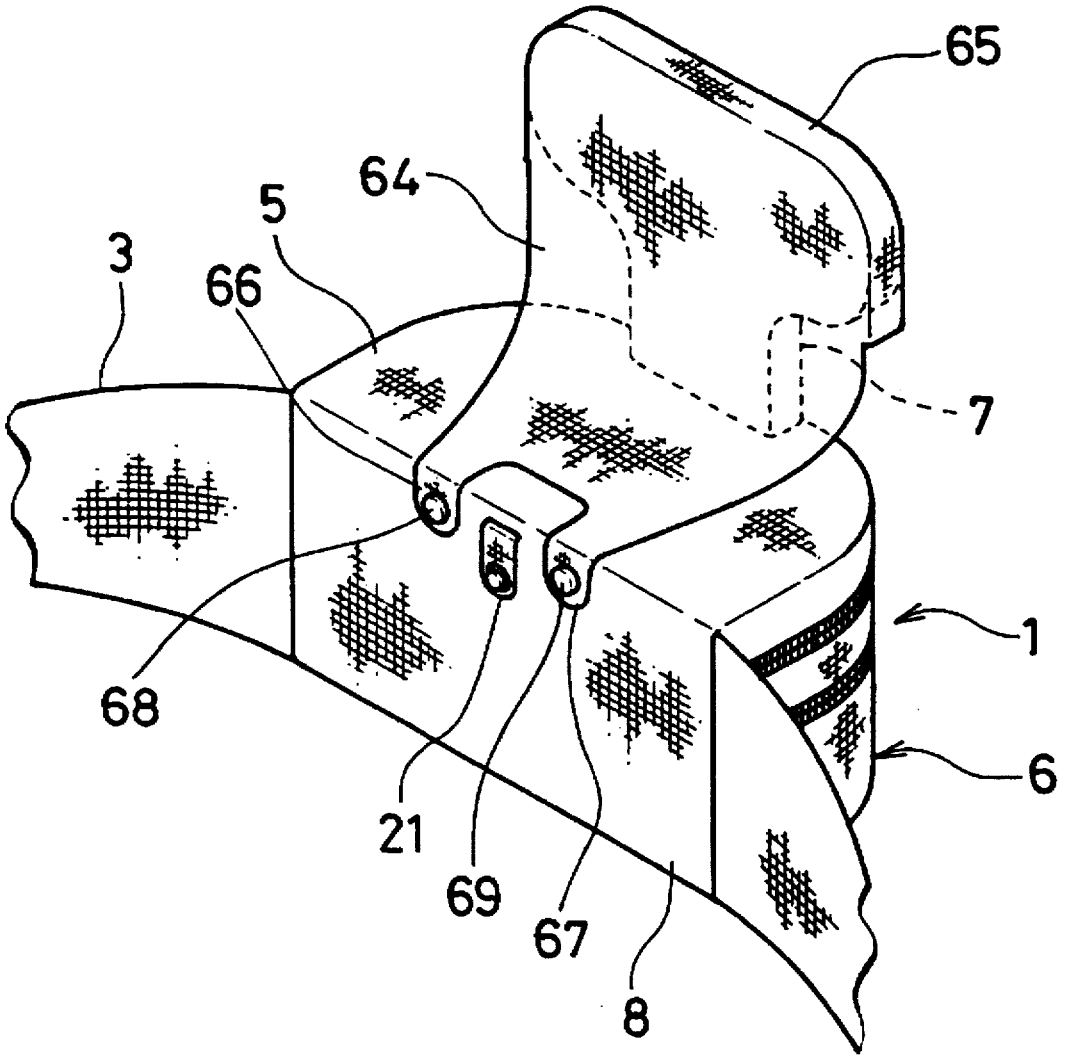
FIG. 25 is a perspective view showing a part of a baby holder 1 according to a further embodiment of the present invention.

As shown in FIG. 25, a curved surface forming member 64 for forming a curved surface along the baby's buttocks may be provided on an internal angle portion which is defined between a pad wall 7 and a seat surface 5. FIG. 25 is a perspective view showing a part of a baby holder 1 from behind the pad wall 7.

Referring to FIG. 25, the curved surface forming member 64 is a flexible sheet material of cloth or the like, and defines a bag part 65 for receiving the upper end portion of the pad wall 7 therein. Two tongues 66 and 67 are formed on an end of the curved surface forming member 64 which is opposite to that provided with the bag part 65 in a manner so as not to interfere with a strap 21, and hooks or snaps 68 and 69 are provided on these tongues 66 and 67 respectively. On the other hand, hooks or snaps (not shown) are provided on a bag 8 for detachably engaging with these hooks or snaps 68 and 69 respectively.

The mounted state of the curved surface forming member 64 shown in FIG. 25 is employed in the mode shown in FIG. 5 or 7. In this mode, the curved surface forming member 64 forms a curved surface along the buttocks of the baby 4, whereby the buttocks of the baby 4 can be further stabilized with a preferable touch for the baby 4. In the mode shown in FIG. 4, on the other hand, the curved surface forming member 64 is folded with the pad wall 7. In order to allow engagement of the hooks or snaps 18 and 19 as shown in FIG. 8 in this state, the bag part 65 of the curved surface forming member 64 is provided with a hole (not shown) for enabling the wearer to draw out the strap 20. In the mode shown in FIG. 6, however, the curved surface forming member 64 having a relatively large width is preferably removed, not to press the crotch of the baby 4.

Figure 26:
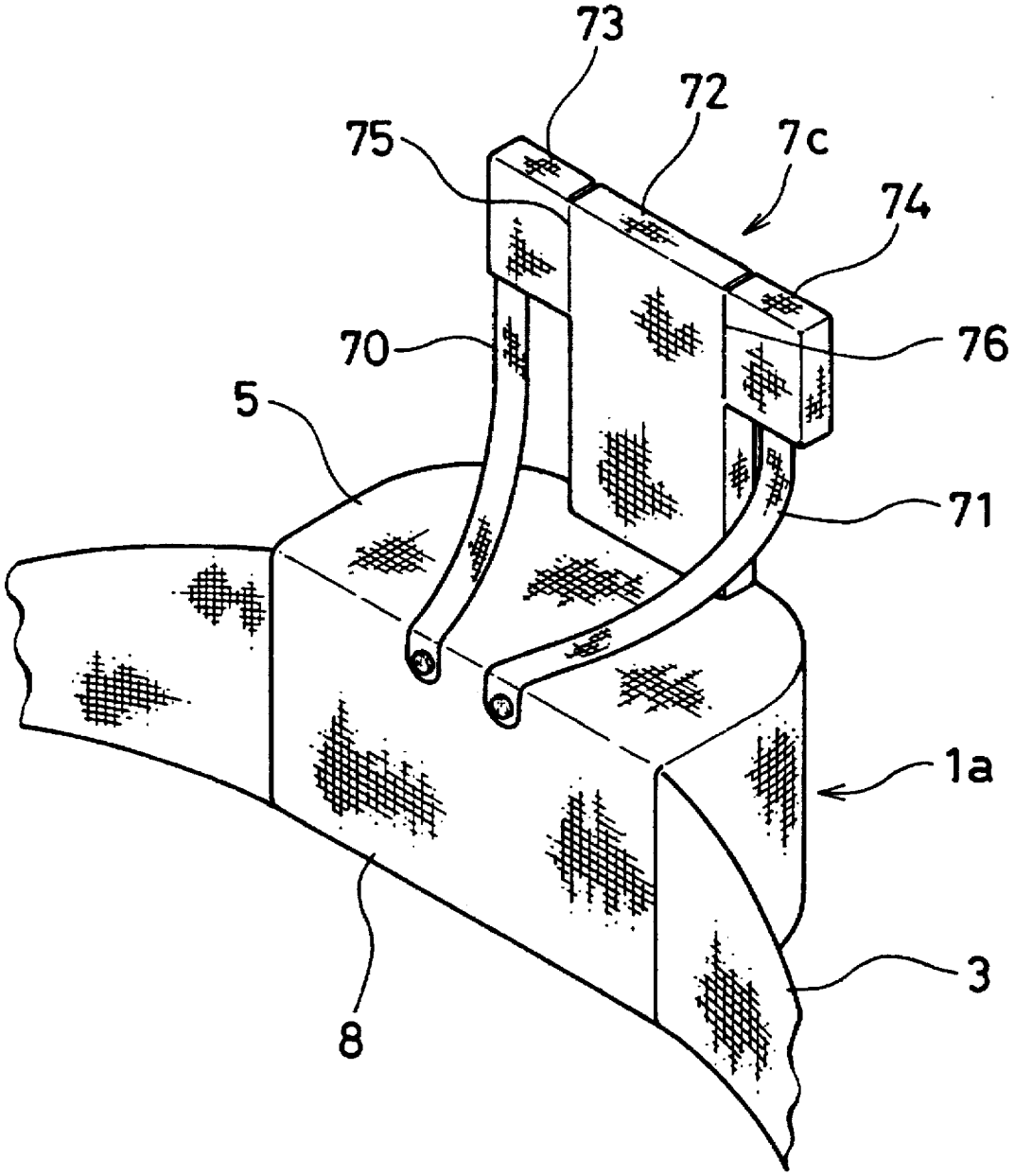
FIG. 26 is a perspective view showing a part of a baby holder **1*a*** according to a further embodiment of the present invention.
Figure 27:
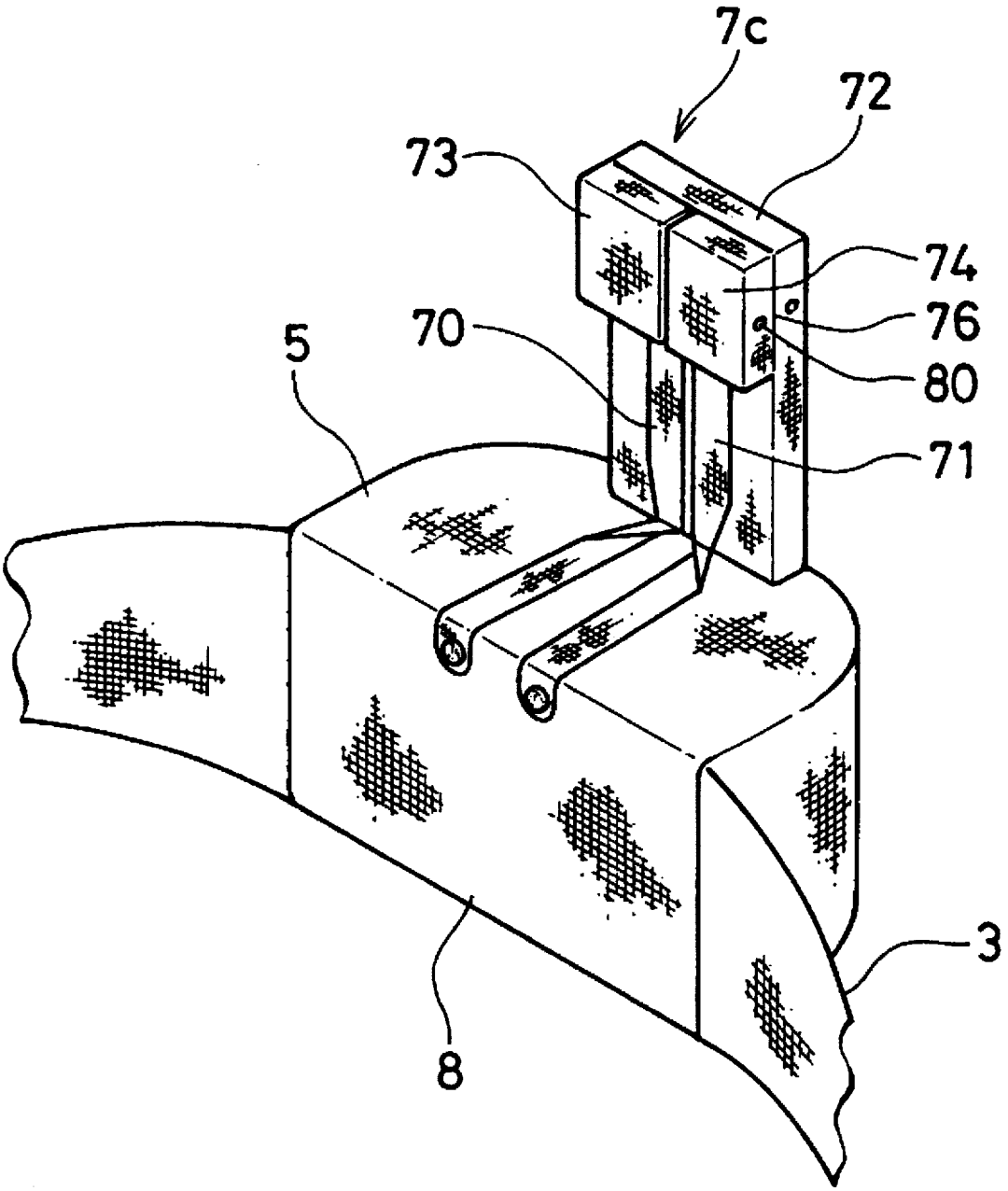
FIG. 27 is a perspective view corresponding to FIG. 26, showing a pad wall **7*c* which is reduced in width in the baby holder 1*a* shown in FIG. 26.
Figure 28:
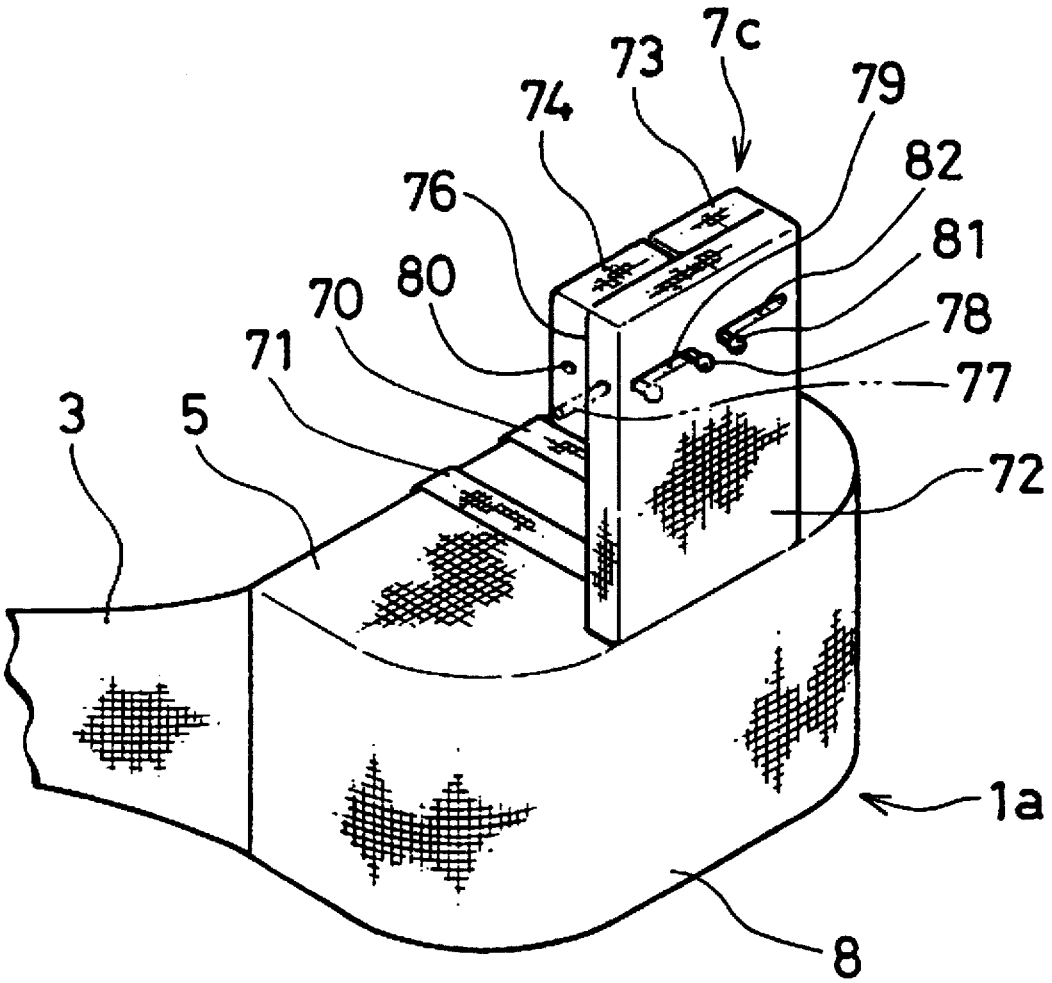
FIG. 28 is a perspective view showing the part of the baby holder 1*a* in the state shown in FIG. 27** from another angle.

FIGS. 26 to 28 show a baby holder la according to a further embodiment of the present invention. The baby holder la shown in FIGS. 26 to 28 comprises a pad wall 7*c* which is adjustable in width, and two curved surface forming belts 70 and 71 corresponding to the aforementioned curved surface forming member 64.

The pad wall 7*c* comprises an upright part 72 which is extended upright from a seat surface 5, and wing parts 73 and 74 extending laterally to the sides from the upright part 72 respectively. As understood from both of FIGS. 26 and 27, the wing parts 73 and 74 are rotatably coupled to the upright part 72 through hinges 75 and 76 respectively, whereby the pad wall 7*c* is adjustable in width. The upright part 72 and the wing parts 73 and 74 are made of resin, for example, and the hinges 75 and 76 can be provided by thin portions of such resin.

In order to maintain the wing parts 73 and 74 in the state extending laterally to the sides from the upright part 72 as shown in FIG. 26, the following structure is employed, for example.

Describing the structure for the wing part 74, a bar 77 (shown in phantom lines) which is rendered axially movable to be capable of projecting sideways is held in the upright part 72, as shown in FIG. 28. The bar 77 is provided with an operation knob 78, which passes through a slot 79 provided in the upright part 72, whereby the knob 78 is movable in this slot 79. On the other hand, the wing part 74 is provided with a hole 80 for receiving the bar 77 when the bar 77 is projecting from the upright part 72. When the wing part 74 has been brought into the state extending sideways from the upright part 72, the operation knob 78 is operated to insert the bar 77 into the hole 80, and therefore, this extending state of the wing part 74 is maintained.

The other wing part 73 is also maintained in the state extending sideways from the upright part 72 by a structure substantially similar to that for the aforementioned wing part 74. FIG. 28 illustrates an operation knob 81 and a slot 82 corresponding to the operation knob 78 and the slot 79 respectively.

The curved surface forming belts 70 and 71 are coupled between the wing parts 73 and 74 and the rear surface of a bag 8 respectively. These curved surface forming belts 70 and 71 extend along the baby's buttocks in the state shown in FIG. 26, thereby stably holding the same while providing a preferable touch for the baby. The state shown in FIG. 26 is employed in the mode shown in FIG. 5 or 7. While a pulling force is applied to the wing parts 73 and 74 in this state through the curved surface forming belts 70 and 71 which are under the weight of the baby 4, the wing parts 73 and 74 can be maintained in the state extending sideways from the upright part 72 due to the action of the aforementioned bar 77 and corresponding second bar.

On the other hand, the state shown in FIGS. 27 and 28 is employed in the modes shown in FIG. 4 and in FIG. 6. In this state, the curved surface forming belts 70 and 71 extend substantially along the upright part 72 and the seat surface 5, not to press the crotch of the baby 4.

While the present invention has been described with reference to some embodiments shown in the drawings, further modifications are available within the scope of the present invention.

While the support 6 is covered with the bag 8 so that the holding core 10 is housed within this bag 8 in each of the illustrated embodiments, for example, the holding core itself may alternatively form the support, without provision of a bag.

While the pad wall 7 has a T-shaped front surface, the same may alternatively have another shape. Although the pad wall 7 is selected in the T shape to be applicable to both of the states of holding the baby 4 backward as shown in FIGS. 5 and 7 and forward facing as shown in FIG. 6 respectively, the pad wall 7 may alternatively have a relatively large uniform width when the baby holder is dedicatedly employed for holding the baby in a backward facing mode. When the baby holder is dedicatedly employed for holding the baby in a forward facing mode, on the other hand, the pad wall 7 may have a relatively small uniform width.

What is claimed is:

1. A baby holder comprising:

a waist strap adapted to be worn around a waist of a person, a support defining a seat surface adapted to receive thereon buttocks of a baby, mounted on said waist strap and positioned to extend from an abdomen of the person, a pad wall rotatably mounted on said support to be capable of selectively assuming a first state extending along said seat surface and a second state extending upright from said seat surface, an elastic member arranged to urge said pad wall in a direction from said first state toward said second state, and a stop member arranged to selectively maintain said pad wall in said first state against an elastic urging force of said elastic member.

2. The baby holder in accordance with claim 1, wherein said pad wall includes a height adjustment mechanism such that a height of said pad wall is adjustable.

3. The baby holder in accordance with claim 1, wherein said pad wall is selectively movably attached to said support so that a horizontal position of said pad wall on said support is adjustable.

4. The baby holder in accordance with claim 3, further comprising a cover plate on which said pad wall is mounted, and a bolt, wherein said support has a channel therein extending in a direction adapted to extend away from the abdomen of the person and a plurality of bolt holes along said channel, said cover plate includes a portion slidably engaged in said channel with a hole in said portion, and said bolt is fastened through said hole in said portion into a selected one of said bolt holes in said channel whereby said pad wall is selectively movably attached to said support.

5. The baby holder in accordance with claim 1, wherein said pad wall is removably attached to said support.

6. The baby holder in accordance with claim 1, wherein said pad wall has a T-shaped front surface.

7. The baby holder in accordance with claim 1, wherein at least an upper portion of said pad wall has two opposite end portions that are respectively curved in directions adapted to approach toward the abdomen of the person.

8. The baby holder in accordance with claim 1, further comprising a curved surface forming member for forming a curved surface along the buttocks of the baby at an internal angle defined between said seat surface and said pad wall in said second state.

9. The baby holder in accordance with claim 8, wherein said curved surface forming member comprises at least one flexible sheet member connected to and spanning between said pad wall and said support such that said flexible sheet member is at least partially suspended above said seat surface.

10. The baby holder in accordance with claim 9, wherein said at least one flexible sheet member comprises two straps having respective first ends respectively connected to said pad wall at two opposite lateral sides thereof and having respective second ends respectively connected to said support.

11. The baby holder in accordance with claim 1, further comprising a support strap having a loop shape connected to and extending from said support adjacent said pad wall, wherein said support has a space therein and an opening into said space adjacent said pad wall, wherein said support strap is adapted to pass along said pad wall, around the baby and over one shoulder of the person in a deployed condition thereof and to pass through said opening and to be stored in said space in a stored condition thereof.

12. The baby holder in accordance with claim 1, wherein said pad wall is rotatably mounted on said support by a pivotal connection located at a side of said support adapted to be directed away from the abdomen of the person, wherein said pivotal connection includes a pivot stop that prevents said pad wall from rotating beyond said second state in a direction away from said first state, and wherein said pad wall has sufficient rigidity that said pad wall is self-supporting.

13. The baby holder in accordance with claim 1, wherein said support has a guide slot at an edge thereof with a plurality of engagement holes passing through a wall of said guide slot, said pad wall includes a pad wall body and a guide leg extending from said pad wall body with an elastically deflectable engaging projection provided on said guide leg, and said guide leg is slidably arranged in said guide slot with said engaging projection projecting into a selected one of said engagement holes, such that a vertical height of said pad wall is adjustable.

14. The baby holder in accordance with claim 1, wherein said support comprises a support core and a bag enclosing said support core, and wherein said bag further encloses a storage space therein and has an opening for accessing said storage space.

15. A baby holder comprising:

a waist strap adapted to be worn around a waist of a person, a support defining a seat surface adapted to receive thereon buttocks of a baby, mounted on said waist strap and positioned to extend from an abdomen of the person, and a pad wall mounted on said support to be extendable upright from said seat surface, wherein said pad wall and said seat surface of said support each respectively comprise therein, at least at an area of a surface adapted to come in contact with the baby, a first cushion member, a second cushion member and a third cushion member in a stacked arrangement with said first cushion member closest to said surface adapted to come in contact with the baby, wherein said second cushion member has a larger elastic coefficient than does said first cushion member and said third cushion member has a larger elastic coefficient than does said second cushion member.

16. A baby holder comprising:

a waist strap adapted to be worn around a waist of a person, a support defining a seat surface adapted to receive thereon buttocks of a baby, mounted on said waist strap and positioned to extend from an abdomen of the person, and a pad wall mounted on said support to be extendable upright from said seat surface, wherein said support comprises a holding core having an upper surface extending along said seat surface and a rear surface adapted to extend along the abdomen of the person for maintaining a shape of said support, and wherein said waist strap includes a front strap part that passes around a front surface of said holding core adapted to face away from the abdomen of the person, and that is fixed to said holding core.

17. The baby holder in accordance with claim 16, wherein said waist strap further includes a rear strap part that passes along said rear surface of said holding core, and wherein said front strap part and said rear strap part are connected with each other on both sides of said holding core.

18. The baby holder in accordance with claim 17, wherein said front strap part is arranged to pass along said front surface of said holding core at a position that is lower than a position of said rear strap part passing along said rear surface of said holding core.

19. A baby holder comprising:

a waist strap adapted to be worn around a waist of a person, a support defining a seat surface adapted to receive thereon buttocks of a baby, mounted on said waist strap and positioned to extend from an abdomen of the person, and a pad wall mounted on said support to be extendable upright from said seat surface, wherein said pad wall includes a width adjustment mechanism such that a width of said pad wall is adjustable.

20. The baby holder in accordance with claim 19, wherein said pad wall includes an upright part that is mounted on said support and two wing parts movably extending respectively laterally from said upright part, and wherein said width adjustment mechanism comprises a slot extending through said upright part with said wing parts slidingly received in said slot, engagement holes passing through a wall of said upright part into said slot, and a respective elastically deflectable engaging projection provided on each said wing part and projecting into a respective selected one of said engagement holes.

21. The baby holder in accordance with claim 19, wherein said pad wall includes an upright part that is mounted on said support and two wing parts movably extending respectively laterally from said upright part, and wherein said width adjustment mechanism comprises two hinge joints respectively rotatably connecting said wing parts to said upright part, with respective axes of said hinge joints extending parallel to a direction of a major extension of said upright part, two sliding bars arranged to be slidable in said upright part to selectively protrude laterally from said upright part, and a respective receiving hole provided in each said wing part for selectively receiving therein one of said sliding bars.

* * * * *